US007743776B2

(12) United States Patent
Okamoto et al.

(10) Patent No.: US 7,743,776 B2
(45) Date of Patent: Jun. 29, 2010

(54) DRY CLEANING APPARATUS AND METHOD CAPABLE OF CLEANING THE CLEANING AGENT

(75) Inventors: Yoichi Okamoto, Kanagawa (JP); Akihiro Fuchigami, Kanagawa (JP); Toshiyuki Mutoh, Kanagawa (JP); Tomoyasu Hirasawa, Tokyo (JP); Tatsuya Satoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 655 days.

(21) Appl. No.: 11/660,781

(22) PCT Filed: May 31, 2006

(86) PCT No.: PCT/JP2006/011349

§ 371 (c)(1),
(2), (4) Date: Feb. 22, 2007

(87) PCT Pub. No.: WO2006/137264

PCT Pub. Date: Dec. 28, 2006

(65) Prior Publication Data

US 2007/0283980 A1 Dec. 13, 2007

(30) Foreign Application Priority Data

Jun. 22, 2005 (JP) ..... 2005-182168
Feb. 28, 2006 (JP) ..... 2006-053852

(51) Int. Cl.
*B08B 13/00* (2006.01)

(52) U.S. Cl. ..... 134/93; 134/104.2

(58) Field of Classification Search ..... None
See application file for complete search history.

(56) References Cited

U.S. PATENT DOCUMENTS 5,018,318 A 5/1991 Hunziker (Continued)

FOREIGN PATENT DOCUMENTS

JP 63 103787 7/1988

(Continued)

OTHER PUBLICATIONS

U.S. Appl. No. 12/244,193, filed Oct. 2, 2008, Murakami, et al.

*Primary Examiner*—Michael Kornakov
*Assistant Examiner*—Ryan Coleman
(74) *Attorney, Agent, or Firm*—Oblon, Spivak, McClelland, Maier & Neustadt, L.L.P.

(57) ABSTRACT

A dry cleaning apparatus which causes cleaning agent to fly in a gas current to impact an object to be cleaned so as to remove extraneous substance attached to the object includes a cleaning tank defining an interior space for accommodating the cleaning agent and the object with the attached extraneous substance, an inflow unit configured to guide a gas current into the cleaning tank through an inlet, an aspiration unit configured to discharge gas from the cleaning tank through an aspiration opening, and a separation unit disposed between the interior space of the cleaning tank and both the inflow unit and the aspiration unit, the separation unit having openings that allow the gas and the extraneous substance to pass through but do not allow the cleaning agent to pass through, wherein the inlet, the aspiration opening, and the separation unit are configured such that relative motion is created between the separation unit and both the inlet and the aspiration opening.

14 Claims, 21 Drawing Sheets

U.S. PATENT DOCUMENTS

| | | | | |
|---|---|---|---|---|
| 5,351,354 | A | 10/1994 | Hasumi et al. | |
| 6,034,351 | A * | 3/2000 | Sato et al. | 219/136 |
| 6,358,328 | B1 | 3/2002 | Yang et al. | |
| 2003/0115710 | A1 | 6/2003 | Choi | |
| 2005/0107017 | A1 | 5/2005 | Fioratti | |

FOREIGN PATENT DOCUMENTS

| | | |
|---|---|---|
| JP | 63 224783 | 9/1988 |
| JP | 4 256477 | 9/1992 |
| JP | 6 182305 | 7/1994 |
| JP | 2 643 103 | 5/1997 |
| JP | 3 288 462 | 3/2002 |
| JP | 2003 122123 | 4/2003 |
| JP | 2003-190247 | 7/2003 |
| JP | 2005-329292 | 12/2005 |

* cited by examiner

DRY CLEANING APPARATUS AND METHOD CAPABLE OF CLEANING THE CLEANING AGENT

TECHNICAL FIELD

The present invention generally relates to an apparatus for removing dust or fine particles attached to an object to be cleaned by use of solid cleaning agent without using water or solvent, and particularly relates to a dry-type cleaning apparatus that cleans components of complex shapes having toner particles (5 to 10 micrometers in diameter on average) attached thereto, which are used in electrophotographic apparatuses (such as copiers and laser printers). The present invention is applicable to cleaning, grinding, deburring, and coating removal for powder process apparatuses.

BACKGROUND ART

Office equipment makers that manufacture copiers, facsimile apparatuses, printers, and the like are actively engaged in recycling activities in which used products or component units are collected from users and then disassembled, cleaned, and assembled again for recycling use as components or as raw materials in order to bring about a resource-recycling society. In order to recycle components used in these products or component units, there is a need for a process that removes fine toner particles attached to these units and components for the cleaning purpose. The important issue is to reduce the cost and environmental load associated with such cleaning.

In the case of a wet-type cleaning method that uses water or solvent, the consumption of energy and environmental load associated with the processing and disposal of waste fluid including toner and the need of a drying process after cleaning are significant, and require high costs.

In the case of a dry-type cleaning method by use of air blow, the cleaning power is not sufficient when toner has strong adhesion, and, also, subsequent process steps are necessary such as manual wiping. Because of this, cleaning is recognized as one of the bottleneck process steps that exist in the recycle and reuse of products.

In order to obviate this problem, the applicant of this invention has developed a cleaning method that utilizes a dry-type cleaning agent (see Patent Document 1). In this method, developer (carrier) used in electrophotographic processes is used as cleaning agent, and toner particles adhering to the object to be cleaned are removed by attaching the particles to the cleaning agent, thereby achieving dry cleaning. The performance of this method is not yet sufficient with respect to the objects to be cleaned for which high cleaning quality (high degree of cleanliness) is required.

Namely, in the case of a cleaning agent utilizing electrostatic absorption, as the cleaning agent becomes dirty (due to the attachment of toner), the power of toner absorption may decrease, and, also, toner may become more likely to be removed from the cleaning agent to be attached again to the object to be cleaned. There is a need to improve the degree of cleanliness of the cleaning agent in order to improve the cleaning quality. The centrifuge separation effect of circling air current (cyclone method) is not sufficient for this purpose in terms of separation power. Further, in order to improve cleaning quality, there is a need to replace the cleaning agent again and again after the cleaning agent absorbs toner, resulting in cleaning inefficiency and the need for a large amount of cleaning agent.

Patent Document 2, for example, discloses an apparatus that uses a discharging device and spherical contact member made of elastic material such as soft urethane formed material to remove dust attached to chargeable objects. In Patent Document 2, the contact member is repeatedly used to remove dust. Because of the repeated use of the contact member, there is the concern of the dropping of cleaning quality as the dust is attached to and accumulated on the contact member.

Further, since a large number of components to be cleaned are simultaneously accommodated in a case for stirring, these components to be cleaned may be scratched or damaged due to collision and contact with each other if the components to be cleaned are easily scratched or heavy and bulky.

Patent Document 3, for example, discloses a barreling apparatus that runs air through a plurality of barreling tanks to eject grinding particles. In Patent Document 3, the surface disposed to oppose the inlet of external air is provided with a dust ejecting unit of a net plate shape, and the suction power of a dust collector is used to eject dust thereby to prevent the grinded object to be covered with dirt. If the suction power of the dust collector is increased in order to improve separation between the grinding particles and the dry media, the dry media may clog the dust ejecting unit of net plate shape. It thus appears difficult to achieve sufficient separation performance.

Since the grinded objects and the dry media are put in the barrel pot for stirring, as in Patent Document 2, there is the concern of scratching and damaging depending on the nature of the grinded objects.

[Patent Document 1] Japanese Patent Application Publication No. 2003-122123

[Patent Document 2] Japanese Patent No. 3288462

[Patent Document 3] Japanese Patent No. 2643103

Accordingly, there is a need for a scheme that improves cleaning quality and cleaning efficiency by improving the motion speed and degree of cleanliness of dry cleaning agent.

There is a further need for a dry cleaning apparatus that does not damage components and does not leave unclean parts even if components of complex shapes are to be cleaned.

DISCLOSURE OF INVENTION

It is a general object of the present invention to provide a dry cleaning apparatus and dry cleaning method that substantially obviate one or more problems caused by the limitations and disadvantages of the related art.

It may be another and more specific object of the present invention to provide a scheme that improves cleaning quality and cleaning efficiency by improving the motion speed and degree of cleanliness of dry cleaning agent.

It may be yet another object of the present invention to provide a dry cleaning apparatus that does not damage components and does not leave unclean parts even if components of complex shapes are to be cleaned.

According to the present invention, a dry cleaning apparatus which causes cleaning agent to fly in a gas current to impact an object to be cleaned so as to remove extraneous substance attached to the object includes a cleaning tank defining an interior space for accommodating the cleaning agent and the object with the attached extraneous substance, an inflow unit configured to guide a gas current into the cleaning tank through an inlet, an aspiration unit configured to discharge gas from the cleaning tank through an aspiration opening, and a separation unit disposed between the interior space of the cleaning tank and both the inflow unit and the aspiration unit, the separation unit having openings that allow the gas and the extraneous substance to pass through but do not allow the cleaning agent to pass through, wherein the inlet, the aspiration opening, and the separation unit are configured such that relative motion is created between the separation unit and both the inlet and the aspiration opening.

According to another aspect of the present invention, a dry cleaning apparatus which causes cleaning agent to fly in a gas current to impact an object to be cleaned so as to remove extraneous substance attached to the object includes a cleaning tank defining an interior space for accommodating the cleaning agent and the object with attached extraneous substance, the cleaning tank configured to guide gas into the interior space through an inlet and to discharge the gas from the interior space through an aspiration opening, a gas current generating unit configured to generate a current of the gas inside the cleaning tank, and a separation unit disposed between the interior space of the cleaning tank and the air current generating unit, the separation unit having openings that allow the gas and the extraneous substance to pass through but do not allow the cleaning agent to pass through, wherein the cleaning agent is made to fly repeatedly after being attached to the separation unit.

According to another aspect of the present invention, a dry cleaning method of removing extraneous substance attached to an object to be cleaned includes disposing the object with attached extraneous substance in a cleaning tank, putting cleaning agent into the cleaning tank, generating a gas current to cause the cleaning agent to fly in the gas current to impact the object so as to remove the extraneous substance from the object, removing the extraneous substance from the cleaning agent inside the cleaning tank, and causing the cleaning agent to fly repeatedly in the gas current.

According to another aspect of the present invention, a dry cleaning method of removing extraneous substance attached to an object to be cleaned includes putting cleaning agent into a cleaning tank, disposing the object with attached extraneous substance in the cleaning tank, sucking gas from inside the cleaning tank while supplying gas into the cleaning tank to stir the gas inside the cleaning tank, causing the cleaning agent to fly in a gas current generated by the stirred gas to impact the object so as to remove the extraneous substance from the object, removing the extraneous substance from the cleaning agent by use of a separation unit having openings that do not allow the cleaning agent to pass through, and causing the cleaning agent accumulated on the separation unit to fly again by use of the gas inflowing into the cleaning tank.

According to at least one embodiment of the present invention, in the dry cleaning apparatus for removing extraneous substance attached to an object to be cleaned by use of cleaning agent flying in the cleaning tank, the separation unit disposed between the interior space of the cleaning tank and the gas current generating unit has openings that allow the gas and the extraneous substance to pass through but do not allow the cleaning agent to pass through, and the cleaning agent is made to fly again after being attached to the separation unit, so that the cleaning agent inside the cleaning tank is repeatedly used for the purpose of cleaning, thereby achieving high cleaning quality without having dust accumulated on the cleaning agent.

According to at least one embodiment of the present invention, in the dry cleaning apparatus for removing extraneous substance attached to an object to be cleaned by use of cleaning agent flying in the cleaning tank, the separation unit disposed between the interior space of the cleaning tank and both the inflow unit and the aspiration unit has openings that allow the gas and the extraneous substance to pass through but do not allow the cleaning agent to pass through, and the inlet and aspiration opening are configured to exhibit a relative motion with respect to the separation unit, so that the extraneous substance attached to the cleaning agent is removed at the separation unit, and the cleaning agent accumulated on the separation unit at the position of the aspiration opening is promptly moved to the position of the inlet, thereby making it possible to use the cleaning agent inside the cleaning tank repeatedly for the purpose of cleaning, and achieving high cleaning quality without having dust accumulated on the cleaning agent.

BEST MODE FOR CARRYING OUT THE INVENTION

In the following, terms used in this specification will be described first.

A cleaning tank is a hollow structure for accommodating objects (work) to be cleaned and cleaning agent. An object to be cleaned is a tangible object subjected to cleaning, and is referred to as an object to be cleaned, work to be cleaned, or simply as work. A separation unit is a filter unit for separating, from cleaning agent, particles attached to the cleaning agent. The separation unit is comprised of a net or slit structure that has a large number of small holes that allow the particles to pass but no cleaning agent to pass. A mesh is a representative of a net or slit structure used as a separation unit, and refers to a metal net, a plastic net, a mesh, a net, a filter made of bonded textile or sponge, a punching (porous) plate, a honeycomb plate, a porous plate, a slit plate, or the like. An attached material is extraneous substance or dirt such as dust or coating film attached to an object to be cleaned, and may be toner particles, for example. The attached material is sometimes referred to as particles, powder, dust, fine particles, attached particles, etc. A blow unit is a unit (such as an air blow nozzle or air gun) for generating a high-speed air current, and is attached to a compressor (compression pump), a high-pressure gas tank, or a blower (fan).

An air current or air blow is meant to include not only a current of air but also a current of nitrogen gas, carbon dioxide gas, an inactive gas such as argon gas, or any proper gas. A high-speed air current refers to an air current that is at least faster than 10 m/s for the purpose of blowing and stirring cleaning agent in the cleaning tank. A dry cleaning agent is solid substance such as metal, ceramic, resin, sponge, or cloth, and is intended to refer to the substance the size that is movable by an air current. A flight speed of cleaning agent refers to the speed at which the cleaning agent flies due to an air current. A thin-piece cleaning agent refers to a resin film piece, a cloth piece, a paper piece, a thin metal piece, or the like having an area size of 1 to 1000 $mm^2$ and a thickness of 1 to 500 micrometers, for example.

Figure 1A:
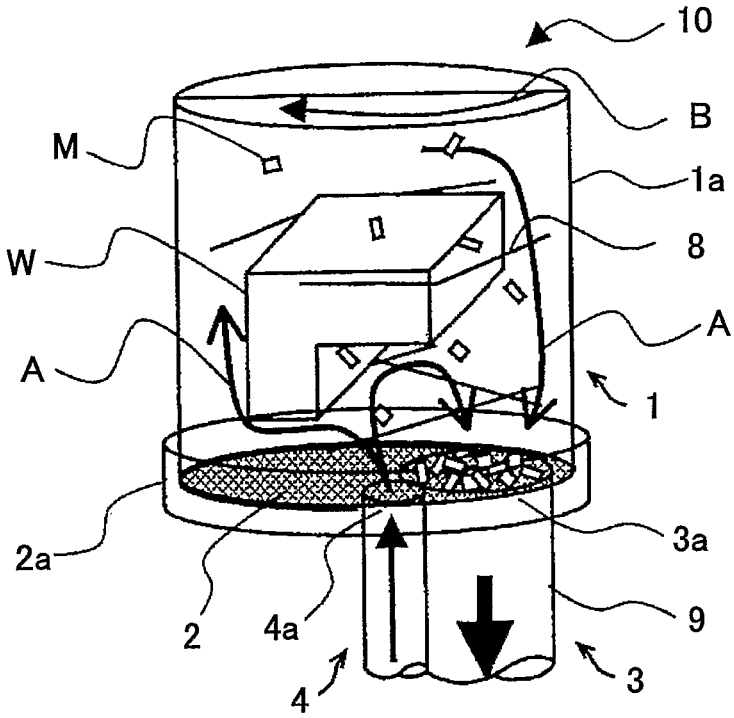
FIGS. 1A and 1B are drawings showing a first embodiment of the present invention.
Figure 1B:
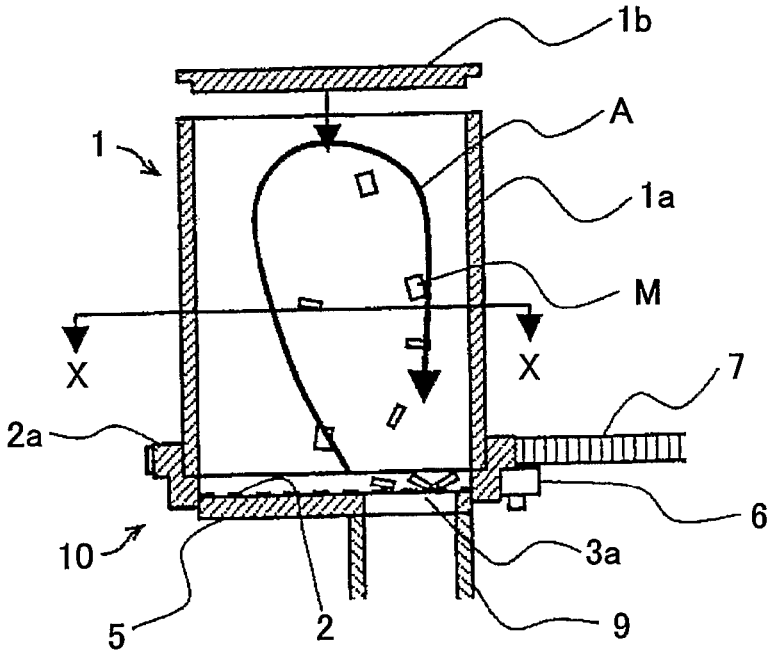

FIGS. 1A and 1B are drawings showing a first embodiment of the present invention. FIG. 1A is a perspective view, and FIG. 1B is a sectional side view.

FIGS. 1A and 1B show a cleaning tank outer cylinder 1, a mesh 2 serving as a separation unit, an aspiration unit 3, an inflow unit 4, a mesh cover 5, a rotation supporting roller 6, a drive belt 7, a work holding unit 8, an aspiration duct 9, a cleaning tank 10, cleaning agent M, an object W to be cleaned (hereinafter referred to as "work"). In the drawings that follow, the same elements having the same functions as described above are referred to by the same numerals.

The basic principle and operation of the present invention will be described by referring to FIGS. 1A and 1B.

The cleaning tank outer cylinder 1 accommodating the work W and the cleaning agent M includes a side wall portion 1*a* having a cylinder shape and a lid portion 1*b* that covers the upper opening provided for the purpose of putting in and taking out the work and the like. The mesh 2 supported by a holding unit 2*a* is fit to the lower opening so as to cover the entirety of the opening. The mesh cover 5 having the aspiration unit 3 and the inflow unit 4 is fixedly mounted below the mesh 2 such as to maintain a short clearance from the mesh 2 and the holding unit 2*a*. The cleaning tank outer cylinder 1, the holding unit 2*a*, and the mesh cover 5 together constitute the cleaning tank 10.

The outer perimeter of the holding unit 2*a* has a step, which is in contact with a plurality of rotation supporting rollers 6, thereby being able to rotate around the center axis of the cylinder.

The drive belt 7 is hocked around outermost perimeter of the holding unit 2*a*. When the drive belt 7 is driven by a drive unit (not shown), the cleaning tank 10 rotates in the direction shown by an arrow B. The cleaning tank outer cylinder 1 and the mesh 2 are integrated as a unitary structure, and are not in contact with the mesh cover 5, so that the mesh cover 5 fixedly mounted does not rotate, and does not obstruct the rotation of the cleaning tank outer cylinder 1.

Figure 2A:
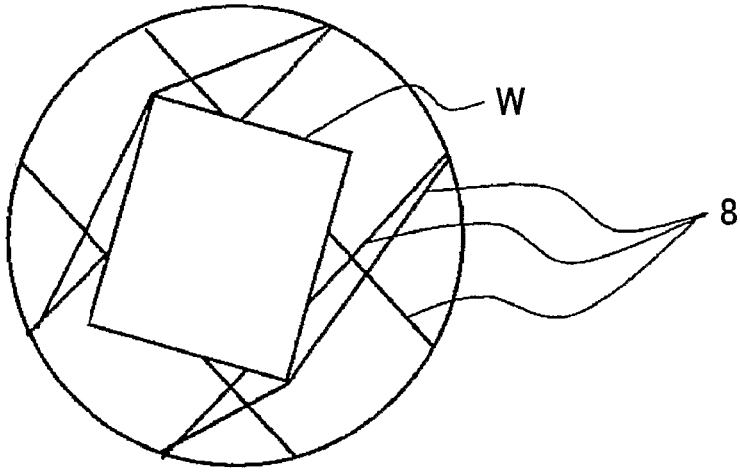
FIGS. 2A and 2B are drawings showing the interior of a cleaning tank as viewed from above.
Figure 2B:
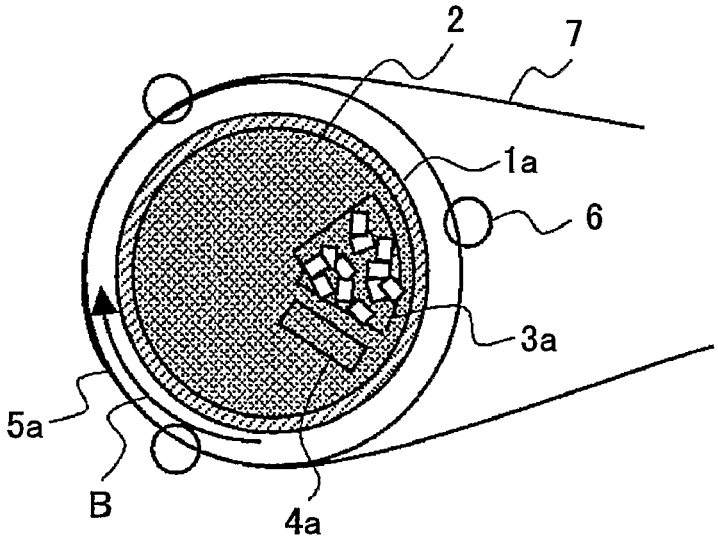

FIGS. 2A and 2B are drawings showing the interior of the cleaning tank as viewed from above. FIG. 2A is provided for the purpose of explaining how to hold the work W, and FIG. 2B illustrates a cross-sectional view taken along the line XX.

The work holding unit 8 holds the work W substantially at the center of the cleaning tank outer cylinder 1. The lid portion 1*b* is placed to seal the upper opening of the cylinder after a large number of pieces of the cleaning agent M are placed inside. The work holding unit 8 supports the work W fixedly with respect to the side wall portion 1*a*.

A dust collecting blower (not shown) is driven to suck air through the aspiration duct 9. As a result, air flows in through an inlet 4*a* of the duct serving as the inflow unit 4 connected to the atmospheric air, so that a large number of pieces of the cleaning agent M are airborne by the air current. Some of the cleaning agent pieces may be attracted to the aspiration duct 9 without ever hitting the work W to be cleaned, but most of the pieces hit the work W to be cleaned to scrape off the dirt before being attracted to the aspiration duct 9. The particles that are scraped off may include those which fly in the air and those which are attached to the cleaning agent M. The particles that fly in the air current are sucked into the aspiration duct 9. The cleaning agent pieces M that are attracted to the aspiration duct 9 collide with the mesh 2 at an aspiration opening 3*a*. Due to the impact of the collision, most of the attached particles are detached from the cleaning agent M so as to be sucked into the aspiration duct 9.

If there is no change in the conditions, the aspiration opening 3*a* will be completely covered with the cleaning agent pieces M, resulting in a drop of the aspiration power and loss of the cleaning capacity. To prevent this, the mesh 2 is rotated as shown by an arrow B. With the position of the aspiration duct 9 and the inlet 4*a* being fixed, the cleaning agent pieces M attracted to the aspiration opening 3*a* are moved with the rotation of the mesh 2 while being attached to the mesh 2, so as to come to the position of the inlet 4*a* situated nearby. At this position, the direction of an air current is opposite, so that the cleaning agent pieces M having been attached to the mesh 2 are blown to the air inside the cleaning tank 10. In this manner, the cleaning agent M cleans the particles attached to the work W, and also has the particles attached to itself cleaned by the mesh 2 serving as the separation unit, thereby allowing the recycling use thereof.

In the embodiment described above and subsequent embodiments, the purpose of the present invention is achieved even if what cleaning agent M is used is not specified.

The cleaning agent may include resin beads, various blast projection materials, brush rolls, sponge balls, or the like. In practice, however, the material, weight, size, and shape of the cleaning agent are selected together with the speed of the air current required inside the cleaning tank based on the characteristics (shape, material, and so on) of the work and the characteristics (diameter, the strength of adherence, and so on) of particles attached to the work.

The inventors of the present invention tried various cleaning agents with respect to components to be cleaned (resin and metal components used in electrophotographic apparatuses) to which toner particles (5 to 10 micrometers in diameter on average) are attached. In the case of the cleaning apparatus shown in the above embodiment, the use of thin-piece agent as cleaning agent exhibited far superior performance over the use of other cleaning agents. The reason may be as described in the following.

Figure 3:
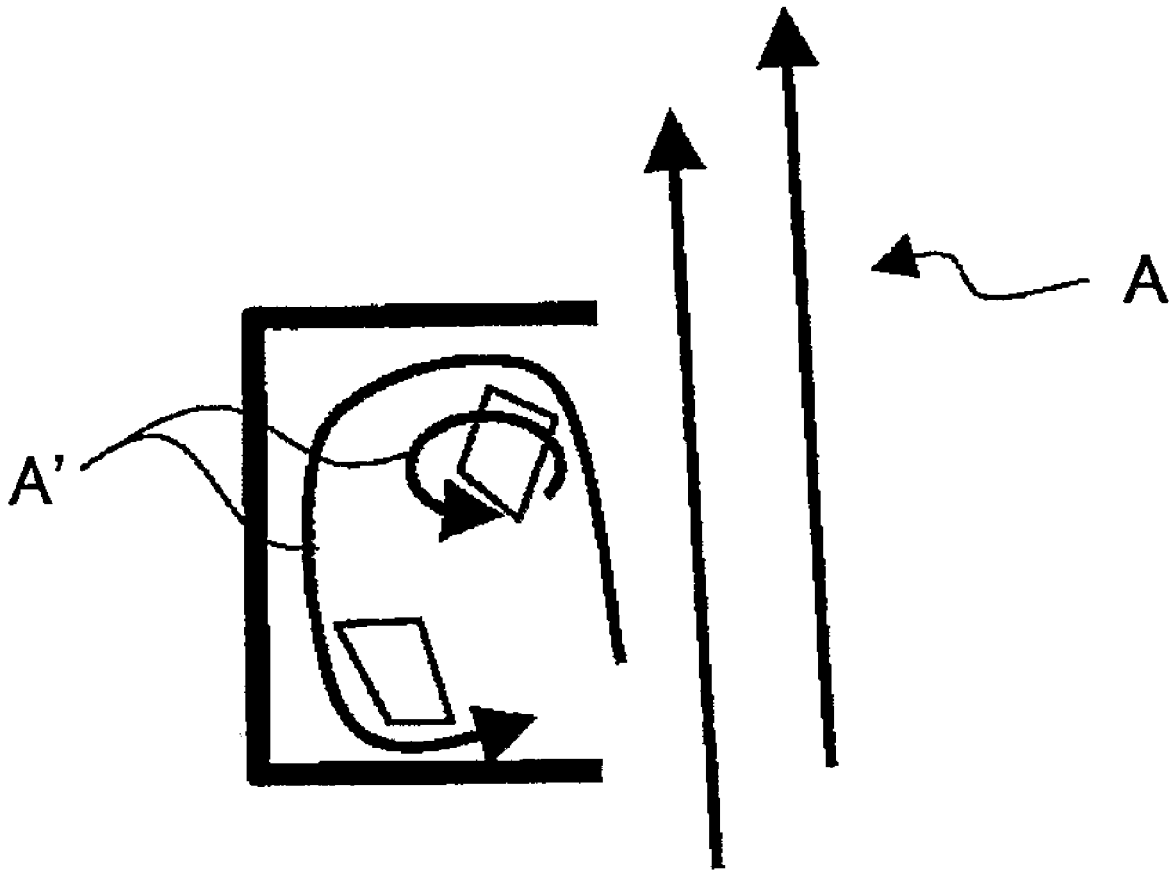
FIG. 3 is a drawing for explaining the complex motion of cleaning agent pieces.

FIG. 3 is a drawing for explaining the complex motion of cleaning agent pieces. The reason why the thin-piece cleaning agent M exhibited superior cleaning performance is because such cleaning agent is superior over other cleaning agents in terms of the capacity to follow the air current (i.e., the capacity to fly at high speed and exhibit complex motion) and the behavior at the time of contact or impact (the effect of the edges, sliding contact, bending effect). In the following, the capacity to follow an air current will be described first.

The thin-pieces cleaning agent M flies at high speed when receiving the power of an air current in the direction in which its projected area is large. This is because its weight is extremely small compared with the air power.

Further, the thin-piece cleaning agent M has a small air resistance in the direction in which its projected area is small. When flying in such a direction, high-speed motion can be maintained for a long distance. The faster the speed of the cleaning agent M, the greater the energy of the cleaning agent M, resulting in the larger force applied to the work W upon impact, and the higher cleaning quality. Further, the faster the speed of the cleaning agent M, the greater the number of circulations of the cleaning agent M repeated inside the cleaning tank 10, resulting in the greater frequency of contacts with the work W, and the higher cleaning efficiency.

Moreover, the thin-piece cleaning agent M changes its air resistance significantly depending on its position in the air, thereby achieving complex motion such as sudden changes in the flight direction rather than simply following the path of the air current. This can provide high cleaning performance even if the work W has a relatively complex shape.

Due to the effect of a high-speed air current A, an air turbulence A' is generated around the work W as shown in FIG. 3. The cleaning agent thin pieces M, which are rather susceptible to air resistance for their weight, exhibit complex motion due to their high capacity to follow the air turbulence A'. Further, the cleaning agent pieces M rotates around themselves and revolves due to the eddies of the air turbulence A' to contact the work W repeatedly, thereby providing high cleaning efficiency even when the work W has a relatively complex shape.

In the following, behavior upon contact or impact will be described.

Figure 4A:
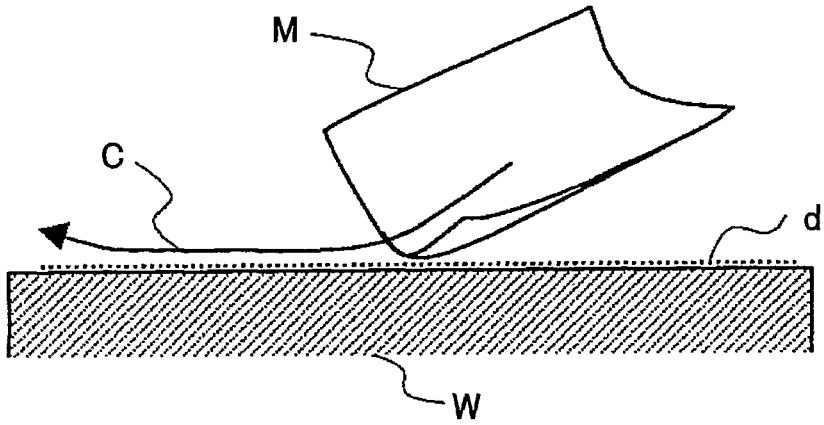
FIGS. 4A and 4B are illustrative drawings for explaining the way particles are removed through sliding contact.
Figure 4B:
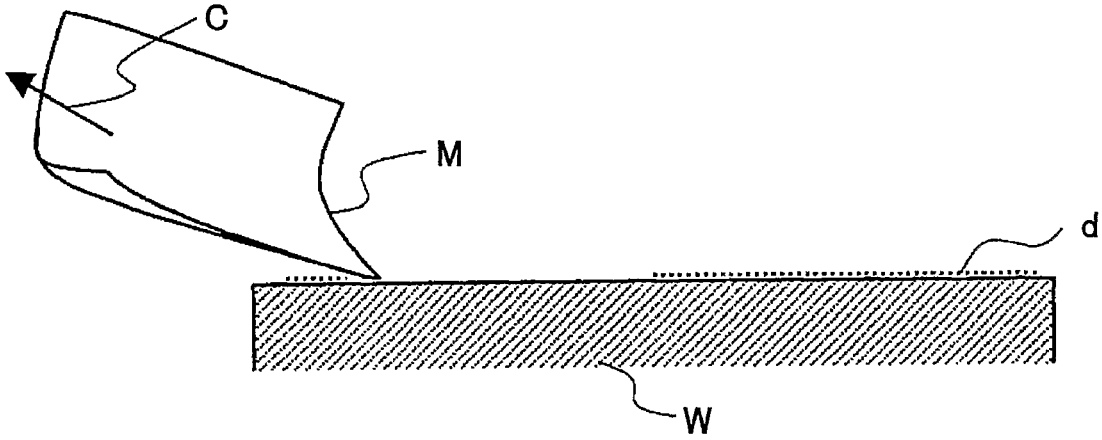

FIGS. 4A and 4B are illustrative drawings for explaining the way the particles are removed through sliding contact. In FIGS. 4A and 4B, particles (attached particles) d are illustrated.

When the thin cleaning agent piece M impacts from its edge first, the power of the impact is concentrated on the edge, so that a sufficient power is exerted to remove particles despite the small weight of the piece. Further, the thin cleaning agent piece can bend to absorb a shock if the power of the impact is large. Unlike the blast shot material or barreling media material typically used, there is no risk of damaging the work W with an excessive power.

When the thin piece bends upon contact or impact, the impact can be regarded as inelastic collision due to the strong effect of the viscosity resistance received from the air. Accordingly, the thin cleaning agent piece M is not likely to bounce back upon impact, so that a sliding contact as shown in FIGS. 4A and 4B occurs when the collision occurs at an angle. In such a case, a single collision can cover a wide contact area, thereby removing a large number of particles d to achieve high cleaning efficiency. In the case of typical shot material or elastic sponge material, on the other hand, bounding back is likely to occur upon impact, which means that the contact efficiency of a single collision is not as high as that of the thin cleaning agent piece M.

In the case of the thin cleaning agent piece M, its wiping motion and scraping motion associated with the sliding contact at the time of contact or impact tend to exert a force to the attached particles d in the direction parallel to the contact surface. It is known that, in general, a small force can remove the attached particles d if the force is applied in the direction parallel to the particle-covered surface rather than if the force is applied in the direction perpendicular to the particle-covered surface.

Further, the thin cleaning agent piece M significantly bends to distort and vibrate upon impact to the mesh 2 (separation unit), which helps to remove the attached particles d attached to the cleaning agent M. This maintains a high degree of cleanliness of the cleaning agent M, and also prevents the attached particles d from being attached again to the work W, thereby achieving high cleaning quality.

What is described above is believed to be the reasons why the thin cleaning agent pieces M exhibit high cleaning quality and high cleaning efficiency with respect to components of relatively complex shapes. A thin piece may have a varying surface shape, and may be a disc shape, a triangular shape, a rectangular shape, a star shape, or the like. These shapes may be mixed and used together. The cleaning capacity may differ depending on the shape of the cleaning agent and also depending on the shape of the work to be cleaned, so that the use of a mixture of various shapes of cleaning agents improves cleaning performance as a whole. If the surface shape is rectangular, long straight edges can be provided, and manufacturing is easy. A triangular shape or star shape allows the tip of a sharp-angle apex to get inside a corner portion such as a recess of the work to be cleaned, thereby leaving less unclean portions.

The same argument also applies in the case of the size of cleaning agent. As for the material of cleaning agent, the use of a general resin film provides flexibility and durability. The use of polyethylene also proves flexibility ensuring that the work to be cleaned be not damaged, and is also cost effective.

Further, when the cleaning agent M is formed as thin pieces, it suffices to use only an extremely small amount of raw material for the cleaning agent M, which can reduce the environmental load and running cost of the cleaning process. These are outstanding features that are not provided by the conventional blast shot materials or barreling media materials. The cleaning apparatus according to the present invention has the configuration suitable to circulate thin cleaning agent pieces M at high speed for the cleaning purpose.

The following embodiments are designed for dry toner (5 to 10 micrometers in diameter) as particles to be removed, which are used in electrophotographic apparatuses such as copiers and laser printers. This is not a limiting example, and the present invention is applicable to a cleaning apparatus or coating-film removing apparatus for removing attached particles or dust in general and also applicable to a deburring apparatus. In such a case, the type of cleaning agent and the speed of air current are selected as appropriate in accordance with the characteristics of work to be cleaned and the characteristics of attached extraneous substance.

If the work (work W) to be cleaned is easily damaged, for example, thin cleaning agent (thin pieces) made of flexible material such as a resin film may be used, such that the easily bendable thin pieces do not damage the object to be cleaned.

If a strong force is necessary for removal such as deburring, thin metal pieces or the like may be used to provide such a strong removal effect.

First Embodiment

A first embodiment of the present invention will be described by referring to FIGS. 1A and 1B and FIGS. 2A and 2B. In the following, a description will be given first of the individual units of the apparatus.

The cleaning tank 10 is configured by using the lid portion 1*b* of disk shape at the top, the side wall portion 1*a* of cylindrical shape, the mesh 2 of disk shape at the bottom, the mesh cover 5 partially covering the mesh 2, and the holding unit 2*a* for holding the mesh 2, which together form a closed space, except for some opening.

The side wall portion 1*a* is a member having cylindrical shape that is fixedly mounted to the holding unit 2*a*. When the holding unit 2*a* is rotated, the side wall portion 1*a* rotates as well, together with the lid portion 1*b*. The side wall portion 1*a* is provided with the work holding unit 8, which will later be described in detail.

Provision may be made such that the side wall portion 1*a* engages the holding unit 2*a* in a slidable manner, and such that the side wall portion 1*a* is rotated to change the position of the work by a rotating unit provided separately from the mesh rotating unit. This provision requires an apparatus configuration that is little more complex, but is desirable if the work to be cleaned is large or heavy or if changes in the position of the work need to be made at low speed.

The lid portion 1*b* is configured to be removable or opened/closed with respect to the side wall portion 1*a* of the cleaning tank 10 for the purpose of putting in and taking out the work W. As the interior of the cleaning tank 10 is set to a negative pressure, the lid portion 1*b* is pressed against the side wall portion 1*a*, thereby providing an improved sealing effect.

The work holding unit 8 is a string-like object (wire, thread, rubber band, or the like) for the purpose of holding the work W, and fixes the work W with respect to the side wall portion 1*a*. As the work holding unit 8 is configured to have string-like shape, its contact area with the work W is small, thereby providing sufficient space for air currents and cleaning agent to act upon the entire surfaces of the work W.

When the side wall portion 1*a* rotates with the mesh 2, the work W fixed by the work holding unit 8 also rotates, thereby changing its position with respect to air currents generated inside the cleaning tank 10. As a general rule, it suffices to change the positional relationship between the work W and the inlet 4*a*, so that the work W may be moved, or the inlet 4*a* may be moved.

The mesh 2 serving as a separation unit has a large number of holes or slits of proper size that allow the particles attached to the work W to pass through while not allowing the cleaning agent M to pass through. As previously described, various variations are possible such as a metal net or filter. In general, those which have little air resistance and to which particles are not easily attached are preferable. In this embodiment, the mesh 2 of disk shape is disposed at the bottom of the cleaning tank 10. With this configuration, it is possible to blow the cleaning agent pieces M to the interior space of the cleaning tank 10 as they settle at the bottom due to the gravitational force, thereby preventing the pooling of the cleaning agent pieces M and achieving efficient cleaning.

The holding unit 2*a* is a circular frame that holds the outer circumference of the disk shape mesh 2, and that has a outer circumference on which teeth are formed to engage a timing belt or gear for rotating the mesh 2.

The mesh cover 5 of disk shape having a plurality of holes is situated close to the mesh 2 to cover the underneath side of the mesh 2 and to form a plurality of openings (i.e., the aspiration opening 3*a* and the inlet 4*a*) at the bottom of the cleaning tank 10.

The aspiration opening 3*a* is connected to the aspiration duct 9 serving as an aspiration unit, which will later be described. Since the mesh cover 5 is fixed to the aspiration unit 3, the mesh cover 5 stays still when the mesh 2 and the cleaning tank outer cylinder 1 rotate.

The inlet 4*a* is exposed to the atmospheric air. Alternatively, the inlet 4*a* is coupled to a blow unit, which will later be described. The area size of the inlet 4*a* is preferably smaller than or equal to the area size of the aspiration opening 3*a*. This ensures that the speed of an air current passing through the inlet 4*a* becomes faster than or equal to the speed of an air current passing through the aspiration opening 3*a*, thereby attaining the same effect as when air is blown into the tank. This increases the flight speed of the cleaning agent M, thereby achieving an increased cleaning performance.

The arrangement of the openings can be different from what is shown in FIG. 1A and FIG. 2B. A plurality of aspiration openings 3*a* and inlets 4*a* may be provided as will later be described. No matter which arrangement is used, an aspiration opening 3*a* and an inlet 4*a* are situated side by side. Such side-by-side arrangement ensures that the cleaning agent M attracted to the mesh 2 by the aspiration unit 3 be reliably positioned to the air blow of the inflow unit 4 before being separated from the mesh 2 by air currents. This makes it possible to make the cleaning agent fly at high speed so as to improve cleaning quality and cleaning efficiency.

The aspiration opening 3*a* serves to provide a negative pressure inside the cleaning tank 10 to eject dust from the cleaning tank 10, and includes the aspiration duct 9 coupled to the aspiration opening 3*a* and a dust collecting blower (not shown). The dust collecting blower includes a filter for filtrating dust and the like ejected from the cleaning tank 10 and a fan or pump for generating a negative pressure. A well-known cyclone filter may be disposed between the filter of the dust collecting apparatus and the cleaning tank 10 so as to separate relatively coarse particles.

The inlet 4*a* of the inflow unit 4 may be exposed to the atmospheric air so as to allow exterior air to flow into the cleaning tank 10 owing to the negative pressure inside the cleaning tank 10. Provision may be made to improve the speed of an air current flowing into the cleaning tank 10 through the inlet 4*a* by additionally providing a blow unit as part of the inflow unit 4. Such blow unit may be a compressed air source, air tube, air blow nozzle, or the like. The blow unit or the nozzle serving as an air outlet may be situated inside the cleaning tank 10, such that an air current is made to blow from above at an angle to hit the cleaning agent M accumulated on the separation unit. In this arrangement, however, the flight speed of the cleaning agent M may not be as high as desired. The blow unit may thus be preferably situated outside the cleaning tank 10. This outside arrangement makes it possible to reliably blow off the cleaning agent M attracted and attached to the separation unit.

When the adherence of dust to the work W is relatively weak, it suffices to make the cleaning agent M fly by use of an air current flowing into the cleaning tank 10 having a negative pressure due to the suction effect of the aspiration unit 3, without using a blow unit. This arrangement is advantageous in that the configuration of the apparatus is simple, and in that the consumption of energy is low. When the adherence of dust to the work W is relatively strong, a high-speed air current generated by the blow nozzle of a compressed air source may be used to improve the cleaning performance. The faster the speed of the air current, the higher the circulation speed of the cleaning agent M inside the cleaning tank 10, and, thus, the more frequent the contact of the cleaning agent M with the work W. This makes it possible to complete the cleaning in a shorter time, thereby improving cleaning efficiency. In order to keep a negative pressure inside the cleaning tank 10 so as to prevent dust from leaking to outside the cleaning tank 10, the speed of the air current generated by the blow unit should be set lower than the speed of the air current of the aspiration unit 3.

In the configuration described above, the speed of air current itself is not an important factor, but the flight speed of the cleaning agent M is an important factor to be considered. The flight speed of the thin-piece cleaning agent M may be higher than or equal to at least 5 m/s, and may preferably be higher than or equal to 10 m/s. The speed of an air current that achieves this flight speed may be higher than or equal to at least 10 m/s, and may preferably be higher than, or equal to 50 m/s.

Figure 5:
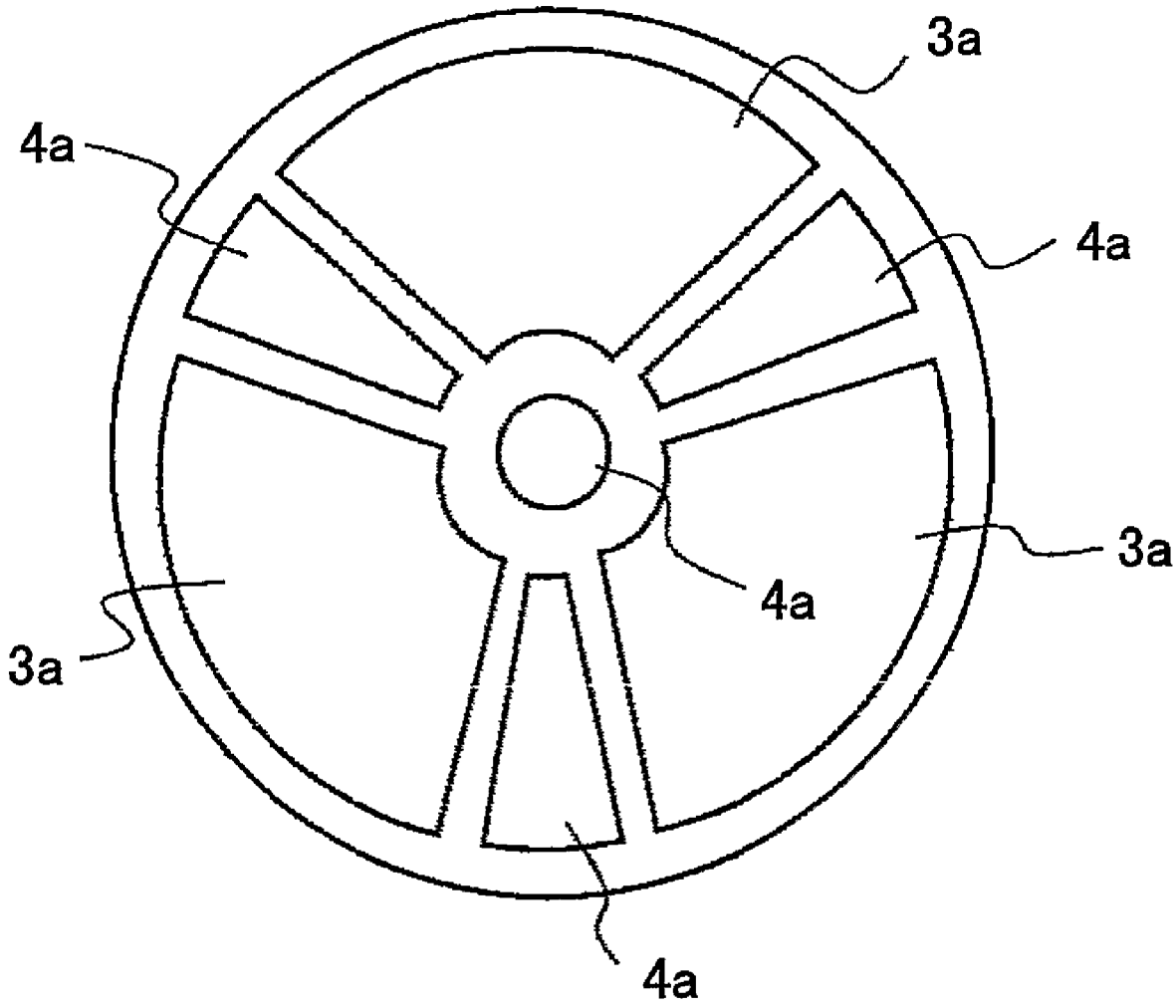
FIG. 5 is a drawing for explaining an example in which a plurality of pairs of an aspiration opening and an inlet are provided.

FIG. 5 is a drawing for explaining an example in which a plurality of pairs of an aspiration opening 3*a* and an inlet 4*a* are provided. In FIG. 5, aspiration openings 3*a* and inlets 4*a* are provided all over the expanse of the mesh 2. The aspiration openings 3*a* and the inlets 4*a* are alternately disposed. Each aspiration opening 3*a* is larger (may be few times larger) in area size than each inlet 4*a*. The larger the difference or ratio between these two, the faster the speed of an inflow air current can be. If the difference or ratio is set too large, the speed at which the cleaning agent M hits the mesh 2 near the aspiration opening 3*a* becomes rather low, which results in the failure to beat off the dust attached to the cleaning agent M.

The mesh rotating unit serves to cause the cleaning agent M attracted to the mesh 2 by the aspiration opening 3*a* to be displaced to the inlet 4*a*, thereby making the cleaning agent M fly away from the mesh 2. If the mesh 2 is not rotated, the mesh 2 near the aspiration opening 3*a* will be quickly clogged by the cleaning agent M. The rotation of the mesh 2 makes it possible to avoid the clogging so as to reuse the cleaning agent M repeatedly by removing dust attached to the cleaning agent M. If it takes time to move the accumulated cleaning agent M attracted to the aspiration opening 3*a* to the inlet 4*a*, some of the cleaning agent pieces M may fly off in the meantime due to air currents inside the cleaning tank 10. These cleaning agent pieces M are not carried by the high-speed inflowing air current, and do not hit the work W to be cleaned at high speed, resulting in a drop of cleaning performance. In order to avoid this problem, as viewed from a point of interest on the mesh 2, the aspiration opening 3*a* and the inlet 4*a* may preferably be arranged such that the inlet 4*a* comes immediately after the aspiration opening 3*a* passes. If these two are arranged in such a manner, the cleaning agent M attracted to the separation unit by the aspiration unit 3 can be positioned reliably to the air blow of the blow unit before the cleaning agent M separates from the separation unit almost spontaneously due to circulating air currents. This ensures that the cleaning agent M is made to accelerate and fly at high speed at the air blow of the blow unit, thereby improving cleaning quality and cleaning efficiency.

In the configuration described above, the mesh 2 is rotated. The same effect and advantage can be achieved by moving the position of aspiration relative to the mesh 2. Provision may be made such that the aspiration opening 3*a* is displaced rather than rotating the mesh 2.

When the cleaning agent M is provided as thin pieces, a discharging unit may be used for post-cleaning discharge so as to prevent the cleaning agent M from being attached to the work W after cleaning through the effect of electrostatic. However, this is not an essential element in this embodiment. As the discharge unit, an ionizer may be used that ionizes moisture or oxide molecules in the air by applying a high voltage to electrodes. The use of the discharging unit makes it possible to prevent the cleaning agent M from being attached to the work W when the work W is taken out of the cleaning tank 10.

The discharging unit may be disposed inside the cleaning tank 10. In such a configuration, however, the performance of the discharging unit may be easily dropped by dust inside the cleaning tank 10 as the dust is attached to the electrodes of the discharging unit. It is thus preferable to provide the discharging unit outside the cleaning tank 10 and near the inlet 4*a*. The discharging unit may be integrally formed as a unitary structure with an air blow nozzle of the blow unit previously described. The use of such discharging unit makes it easier to remove dirt attached to the cleaning agent M, thereby achieving high-quality cleaning. As a discharging unit provided outside the cleaning tank 10 to discharge the interior of the cleaning tank 10, a discharging unit that ionizes air through X-ray exposure may be used.

Further, a discharging unit may be operated during the cleaning operation to supply ionized air to inside the cleaning tank 10, which makes it easier to remove extraneous substance such as dust attached to the cleaning agent M, thereby achieving high-quality cleaning. This arrangement also prevents the cleaning agent pieces M from being attached to each other, and thus improves the circulation of the cleaning agent M inside the cleaning tank 10, thereby improving the frequency of contacts of the cleaning agent M with the work W to achieve higher cleaning efficiency. This arrangement further prevents the cleaning agent M from being attached to the work W, from covering its surfaces, and from hampering cleaning.

In the following, the operation of the cleaning apparatus described above will be described.

1. A negative pressure is generated inside the cleaning tank 10 by the operation of the aspiration unit 3, so that air flows into the cleaning tank 10 from the exterior through the mesh 2 at the inlet 4*a*. The area size of the inlet 4*a* is adjusted as appropriate as previously described, which makes it possible to generate a high-speed air current inside the cleaning tank 10 without using a blow unit. If a blow unit is used, an air current of higher speed can be generated to make the cleaning agent M fly at high speed, thereby achieving high cleaning performance.

2. The cleaning agent pieces M scattered on the mesh 2 are blown off of the mesh unit by the air current flowing through the inlet 4*a* (or a blow nozzle) so as to fly in the air currents inside the cleaning tank 10.

3. The cleaning agent M flying inside the cleaning tank 10 comes in contact with or collides with the work W to be cleaned so as to beat off the dust attached to the work W. The beat-off dust is carried by an air current moving toward the aspiration opening 3*a* so as to be ejected from the cleaning tank 10.

3'. Due to the contact or collision of the cleaning agent M with the work W to be cleaned, some of the dust attached to the work W is attached to the cleaning agent M. The cleaning agent M is carried by the air current moving toward the aspiration opening 3*a* to collide with the mesh 2, which results in the dust attached to the cleaning agent M being removed.

[Recycle of Cleaning Agent]

4. At the mesh unit near the aspiration opening 3*a*, a high-speed aspiration air flow acts upon the cleaning agent M. The dust attached to the cleaning agent M is further removed from the cleaning agent M by the high-speed aspiration air flow so as to be ejected to outside the cleaning tank 10 without adhering to the work W or the cleaning agent M again. If a discharging unit (ionizer) is provided, an electrostatic attraction force between the cleaning agent M and the dust is weakened, resulting in an easier separation of the dust.

5. The cleaning agent M attached to the mesh unit by aspiration (suction) is displaced to the position of the inlet 4*a* (or a blow nozzle) as the mesh 2 is rotated.

The operations 1 through 5 described above are repeated, so that the cleaning agent M circulates at high speed inside the cleaning tank 10 while experiencing a repeating cycle of high-speed flight, cleaning (contact with the work W to be cleaned), and recycling (attracted and attached to the mesh 2 to remove the attached dust). The air currents and the motion of the cleaning agent M inside the cleaning tank 10 may be illustrated as shown in FIG. 1A.

In this embodiment, the cleaning tank 10 rotates together with the rotation of the mesh 2, so that the work W to be cleaned fixedly mounted to the cleaning tank 10 is subjected to the air currents and the cleaning agent pieces M coming from various directions as the cleaning tank 10 rotates. This makes it possible for the cleaning agent pieces M to contact or impact all the surfaces of the work W to be cleaned, thereby uniformly cleaning even a component of complex shape.

Even if the dust has a strong adherence and is thus hard to remove by relying only on an air blow, the contact or impact of the cleaning agent M flying at high speed makes it possible to remove the dust from the work W to be cleaned. Especially, when the thin-piece cleaning agent M is used, high cleaning quality and high cleaning efficiency are achieved as previously described.

Further, the separation unit effectively removes the dust attached to the cleaning agent M so as to maintain a high degree of cleanliness of the cleaning agent M. This prevents the dust attached to the cleaning agent M from adhering to the work W again, thereby achieving high cleaning quality.

As described above, the use of the cleaning apparatus and the cleaning agent described in the present embodiment achieves high quality and highly efficient cleaning even if the work W has complex shape and/or even if the dust has a strong adherence and is thus hard to remove by relying only on an air blow.

Table 1 shows an example of results of cleaning.

Thin cleaning agent pieces M each of which was a polyethylene film piece of 30 micrometers by 5 mm were used. In order to observe the effect of a difference in the adherence of the extraneous substance (toner) to be removed, heat was applied at a predetermined temperature for one hour after the toner had been attached, and samples having different amounts of attached toner were prepared.

As comparative examples, the results of cleaning by use of air-blow-based dry cleaning and ultrasound water cleaning are shown. An air nozzle made by Silvent was used for air blow, and the pressure of compressed air was 0.7 MPa. For the ultrasound water cleaning, an ultrasound cleaning apparatus (250 W) made by Sharp was used, and alkaline electrolyzed water and surface active surfactant were used as cleaning liquid. As is understood from Table 1, the first embodiment of the present invention exhibited a cleaning performance compatible to that of the ultrasound water cleaning, despite the fact that the present invention did not use water.

TABLE 1

| ADHERENCE | WEAK | MIDDLE | STRONG |
|---|---|---|---|
| AIR BLOW | 1 | 0 | 0 |
| ULTRASOUND | 3 | 2 | 1 |
| INVENTION | 3 | 2 | 1 |

0: UNCLEAN (ALMOST NO EFFECT OF CLEANING)
1: PARTIALLY UNCLEAN
2: SUBSTANTIALLY CLEAN
3: EXTREMELY CLEAN

Figure 6A:
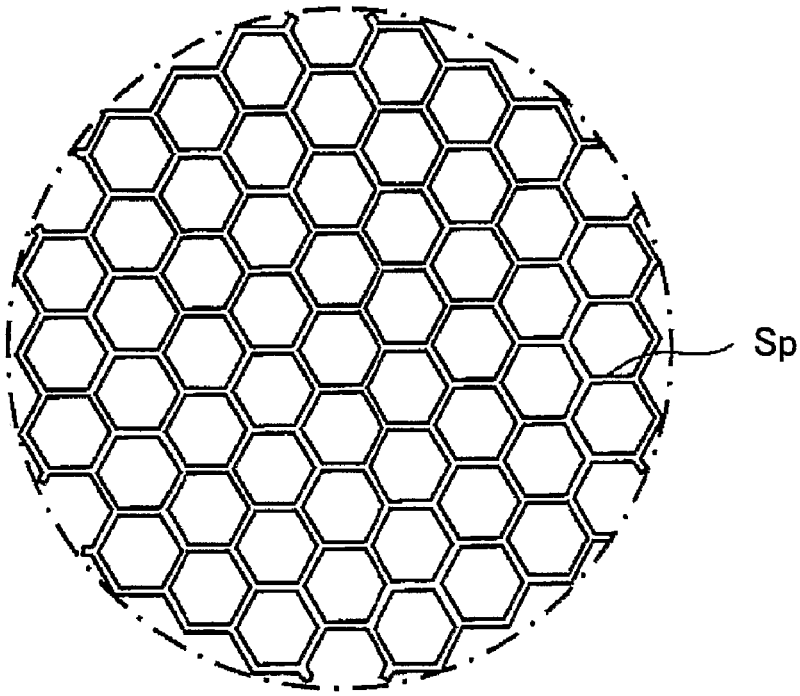
FIGS. 6A and 6B are drawings showing an example of partitions arranged at close spacing on a mesh.
Figure 6B:
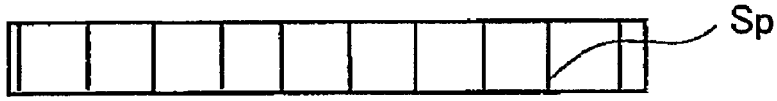

FIGS. 6A and 6B are drawings showing an example of partitions arranged at close spacing on the mesh 2. In FIGS. 6A and 6B, symbol Sp represents partitions. The partitions Sp are made by slicing a cylindrical honeycomb plate. Each cell (opening) of the honeycomb structure has the size sufficiently larger than the size of the cleaning agent M. The partitions Sp are placed in contact with the mesh 2 so as to eliminate air currents around the mesh in the direction parallel to the mesh surface. This can regulate the movement of the cleaning agent M rolling over on the mesh 2. In particular, when the cleaning agent M attracted to the mesh 2 near the aspiration opening 3*a* is displaced to the position of the inlet 4*a* by the rotation of the mesh 2 and the partitions Sp, the cleaning agent M is prevented from returning to the position of the aspiration opening 3*a* due to the attraction force of the aspiration opening 3*a*. The cleaning agent M can thus be reliably made to fly inside the cleaning tank 10. Further, the effect and advantage of an extended tip of a blow nozzle can be obtained, regulating air currents blowing from the blow unit, increasing the flight speed of the cleaning agent M, and improving the cleaning performance.

Second Embodiment

Figure 7A:
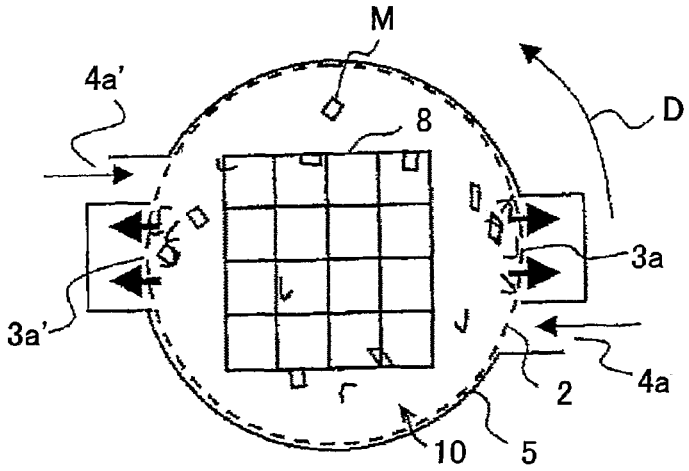
FIGS. 7A and 7B are drawings showing the configuration of a second embodiment of the present invention.
Figure 7B:
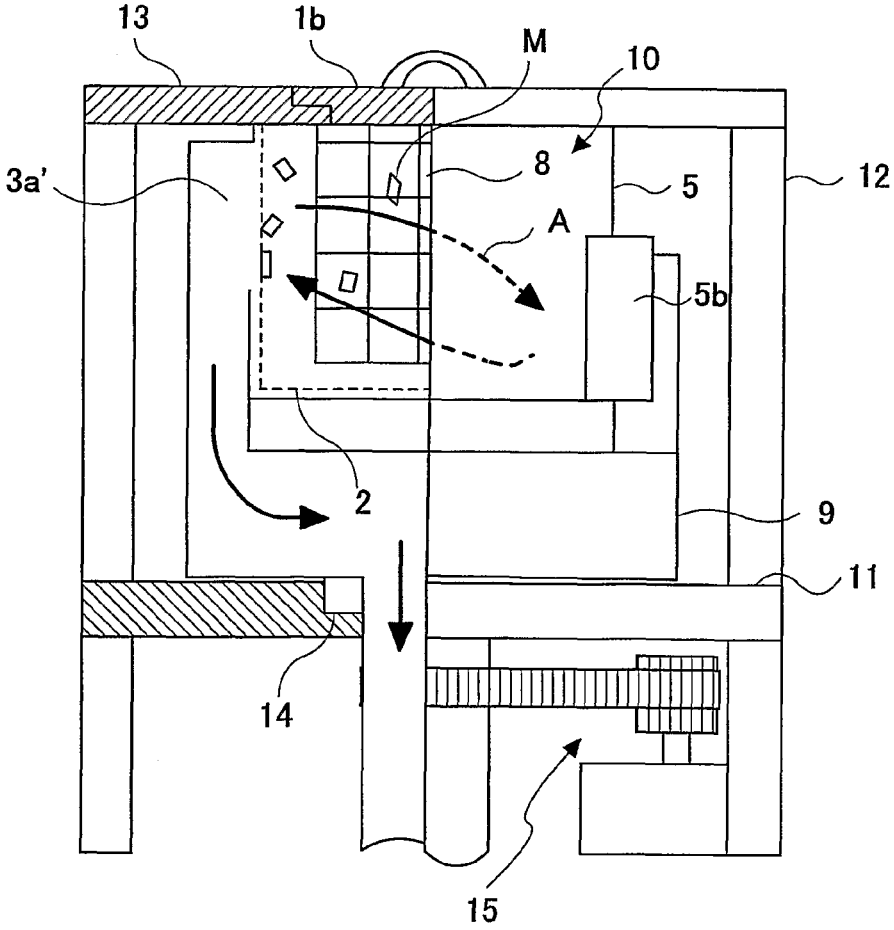

FIGS. 7A and 7B are drawings showing the configuration of a second embodiment of the present invention. FIG. 7A is a plan view of the cleaning tank, and FIG. 7B is a partial sectional side view.

The aspiration duct 9, a base plate 11, a support pillar 12, a top panel 13, a rotation shaft bush 14, a rotation drive unit 15, and a direction D of the rotation of the aspiration duct 9 are shown. In this embodiment, the mesh 2 is fixed whereas the aspiration opening and the inlet are made to rotate. In the following, each unit will be described.

The mesh 2 serving as a separation unit is a mesh that allows no cleaning agent M to pass through while allowing yet-to-be-removed dust to pass through. The mesh 2 has a cylindrical basket-like shape and is fixedly mounted to the top panel 13. The mesh cover 5 covers the outer perimeter of the cylindrical-shape mesh 2 to separate the cleaning tank 10 from the outside air. The mesh cover 5 rotates, with the interior wall thereof positioned in close proximity to the cylindrical mesh 2. At one end of the mesh cover 5 is provided a first aspiration opening 3*a*, and at the opposite end of the mesh cover 5 is provided a second aspiration opening 3*a*'. The first aspiration opening 3*a* is disposed at a lower part of the cleaning tank 10 whereas the second aspiration opening 3*a*' is disposed at an upper part of the cleaning tank 10. A first inlet 4*a* is situated at a position adjacent to the first aspiration opening 3*a*, and a second inlet 4*a*' is situated at a position adjacent to the second aspiration opening 3*a*'. The inlets 4*a* and 4*a*' are exposed to the atmospheric air. In order to increase the speed of air flowing into the cleaning tank 10 through the inlets 4*a* and 4*a*', the area size of the inlets 4*a* and 4*a*' is preferably about 10 to 90% of the area size of the aspiration openings 3*a* and 3*a*', respectively.

Figure 8:
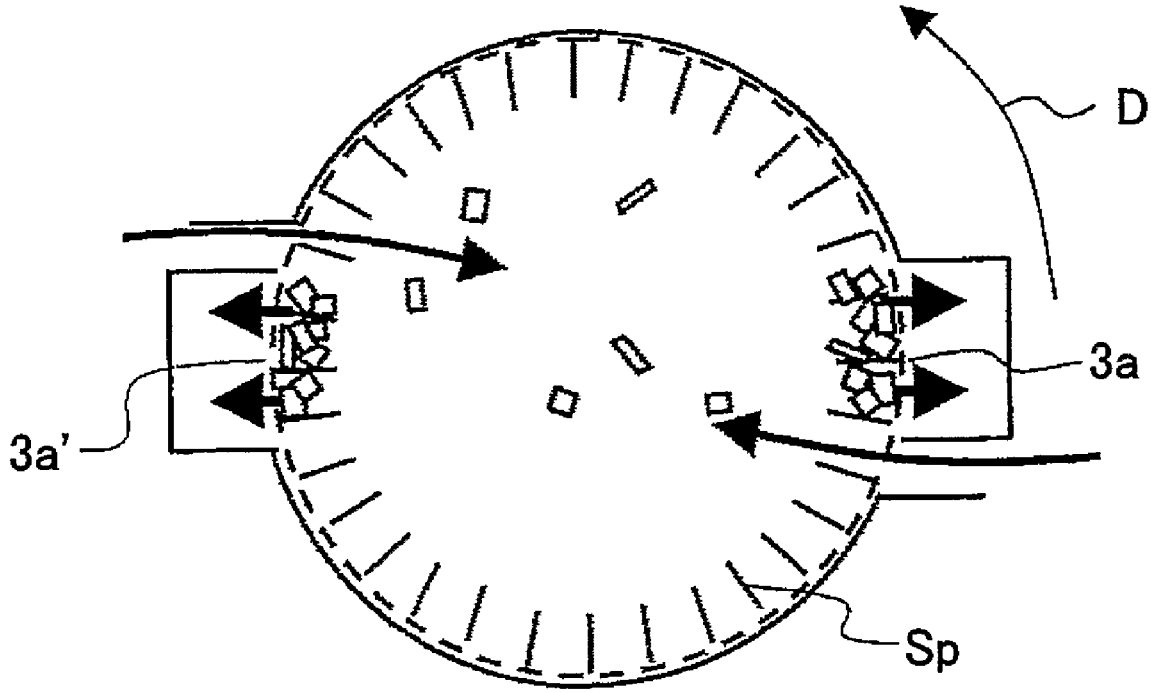
FIG. 8 is a drawing showing partitions arranged in close proximity to a mesh side wall.

FIG. 8 is a drawing showing partitions arranged in close proximity to the mesh side wall. As shown in FIG. 8, partitions Sp of rib shape or fin shape extending in the direction of the center axis of the cylinder are formed inside the mesh 2 (i.e., on the side where the work W to be cleaned is placed). This serves to regulate the movement of the cleaning agent M in the circumferential direction on the mesh 2, thereby preventing the cleaning agent M from returning to the aspiration opening 3*a* so as to fail to fly in the air current blowing through the inlet 4*a*. Further, this serves to regulate the direction of the air current flowing through the inlet 4*a* so as to increase the speed of the air current, thereby increasing the speed of the air current and cleaning agent M inside the cleaning tank 10 so as to improve the cleaning effect. Provided that the same effect is achieved, the partition Sp may be configured as having a lattice shape or honeycomb shape.

A reference numeral 5*b* designates a wind-direction regulating plate, which rotates together with the mesh cover 5, and serves to adjust the direction of the air current flowing into the cleaning tank 10. The wind-direction regulating plate 5*b* may be configured as a separate member attached to the mesh cover 5, or may be integrally formed as a unitary structure with the mesh cover 5 by bending a portion of the mesh cover 5 to outside at the position of the aspiration opening 3*a* and the inlet 4*a*.

The first aspiration opening 3*a* and second aspiration opening 3*a*' are coupled to the aspiration duct 9, which is coupled to a dust collecting blower (not shown). The aspiration duct 9 is supported by the rotation shaft bush 14 so as to be rotatable with respect to the base plate 11, and is made to rotate by the rotation drive unit 15. A motor and belt are shown as an example of the rotation drive unit 15. A typical rotation joint may be used between the aspiration duct 9 and the dust collecting blower (not shown).

The work holding unit 8 is a basket having holes that allow an easy passage of the cleaning agent M while allowing no passage of the work W to be cleaned, and is fixedly mounted to the top panel 13. The lid portion 1*b* of the cleaning tank 10 provided at the top panel 13 is opened when putting or taking the work W into or out of the work holding unit 8. Illustration of the work W is omitted.

In this example, the work holding unit 8 is fixed without movement, and the position of the aspiration opening 3*a* and the inlet 4*a* is made to rotate with respect to the work W, thereby making it possible for the work W to be subjected to air currents and the cleaning agent M coming from various directions, which achieves the cleaning of all the surfaces of the work W.

As the cleaning agent M, various shapes and materials may be used as long as it is solid and capable of flying in an air current. Because of the reasons previously described, however, thin-pieces cleaning agent may be preferable.

In the following, the operation of the cleaning apparatus will be described. As the dust collecting blower is powered on, a negative pressure is created inside the cleaning tank 10, so that the exterior air flows into the cleaning tank 10 through the inlet 4*a*. The area sizes of the aspiration opening 3*a* and the inlet 4*a* are adjusted as appropriate as previously described, which makes it possible to generate a high-speed air current inside the cleaning tank 10. In this embodiment, an air current moves from the first inlet 4*a* to the first aspiration opening 3*a* and to the second aspiration opening 3*a*', and another air current moves from the second inlet 4*a*' to the first aspiration opening 3*a* and to the second aspiration opening 3*a*'. Most of the cleaning agent pieces M fly along the air currents to be attracted to the mesh portion at the position of the aspiration openings 3*a* and 3*a*'.

As the rotation drive unit 15 is operated to rotate the aspiration duct 9 in a direction indicated by an arrow D, the cleaning agent pieces M attracted to the mesh at the position of the aspiration opening 3*a* are blown off by the air current flowing into the cleaning tank 10 through the inlet 4*a*, thereby contacting or impacting the work W at high speed. As the cleaning agent pieces M contacts or impacts the work W to be cleaned, the dust attached to the work W is wiped off or scraped off so as to be removed from the work W. Most of the removed dust is carried by an air current to move toward the aspiration opening 3*a* so as to be ejected to outside the cleaning tank 10. Some of the dust may adhere to the cleaning agent pieces M. As the cleaning agent pieces M are attracted again to the aspiration opening 3*a* to collide with the mesh 2, such dust is removed from the cleaning agent M and ejected through the aspiration opening 3*a*.

Since the position of the aspiration opening 3*a* and the inlet 4*a* changes due to the rotation of the aspiration duct 9, the condition of air currents change inside the cleaning tank 10. Further, since the height of the first inlet 4*a* and the first aspiration opening 3*a* differs from the height of the second inlet 4*a*' and the second aspiration opening 3*a*', the condition of air currents varies inside the cleaning tank 10 in the horizontal direction and vertical direction. Accordingly, the cleaning agent pieces M contact or impact the work W to be cleaned from all the directions, thereby cleaning all the surfaces of the work W uniformly even if the work W has a relatively complex shape.

Third Embodiment

Figure 9A:
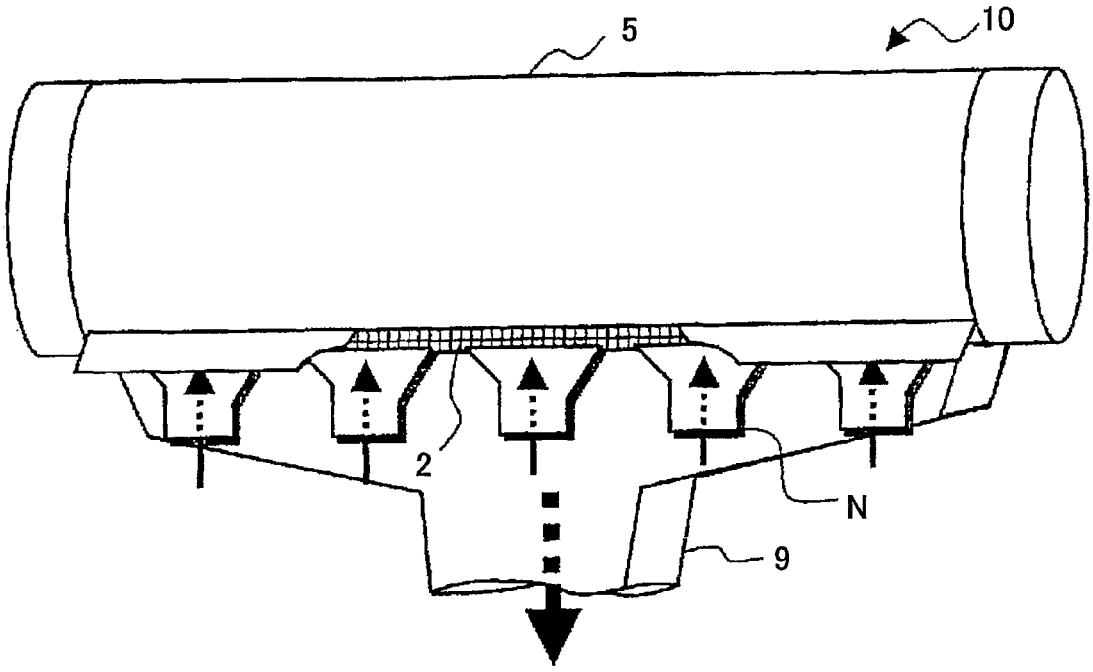
FIGS. 9A and 9B are drawings showing the configuration of a third embodiment of the present invention.
Figure 9B:
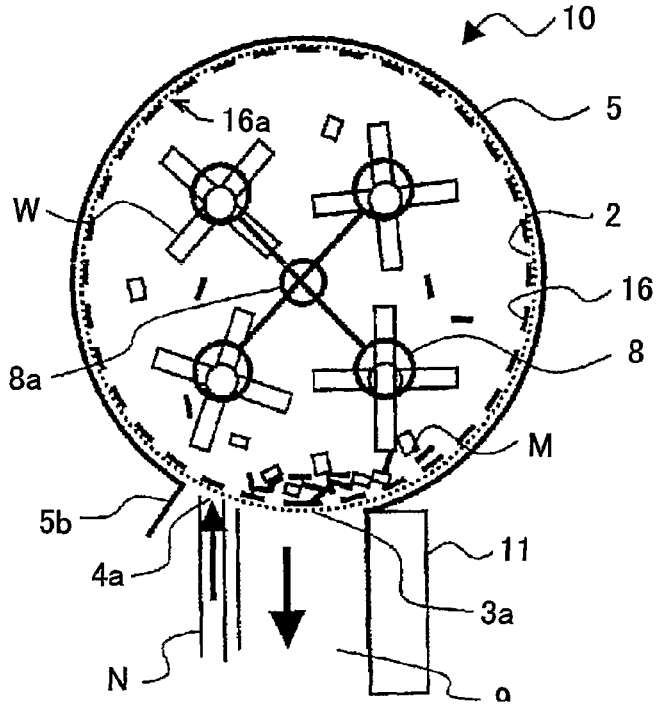

FIGS. 9A and 9B are drawings showing the configuration of a third embodiment of the present invention. FIG. 9A is a perspective view of the cleaning tank, and FIG. 9B is a sectional side view.

In FIGS. 9A and 9B, reference numeral 16 designates a cylindrical inner tube, and reference symbol N designates an air blow nozzle. In this embodiment, the mesh 2 is disposed on the side wall of the inner tube 16, which is placed in a horizontal position. This arrangement is suitable when cleaning a relatively-long-size component. In this embodiment, the same elements as those of the first embodiment are referred to by the same numerals, and a description thereof will be omitted.

All over the lateral side of the inner tube 16 serving as a mesh holding unit are provided coarse slits 16*a* that extend in the axial direction. The mesh 2 having finer mesh pattern than the slits 16*a* is wrapped around the outer surface of the inner tube 16 and welded for fixed mounting. The cleaning agent M is configured such as to pass through the slits 16*a* but not to pass through the mesh 2. As in the second embodiment, the partitions Sp of rib or fin shape may be provided inside the mesh 2 to further improve the cleaning performance.

The mesh cover 5 is a cylindrical cover that covers the perimeter of the mesh 2 that is fixed to the outer surface of the inner tube 16. The mesh cover 5 supports the inner tube 16 and the mesh 2 in a slidable and rotatable manner, and serves to create a sealed space inside the cleaning tank 10. One end 5*b* of the mesh cover 5 is bent toward outside as shown in FIG. 9B, serving to regulate the flow of an air current flowing into the cleaning tank 10 from the air blow nozzle N. The air blow nozzle N is used as an example in this embodiment. The inlet may be exposed for the intake of the atmospheric air if such configuration provides sufficient cleaning performance. In this embodiment, the portion of the mesh connected to the aspiration duct 9 serves as the aspiration opening 3*a*, and the portion of the mesh coupled to the blow nozzle N serves as the inlet 4*a*.

Figure 10:
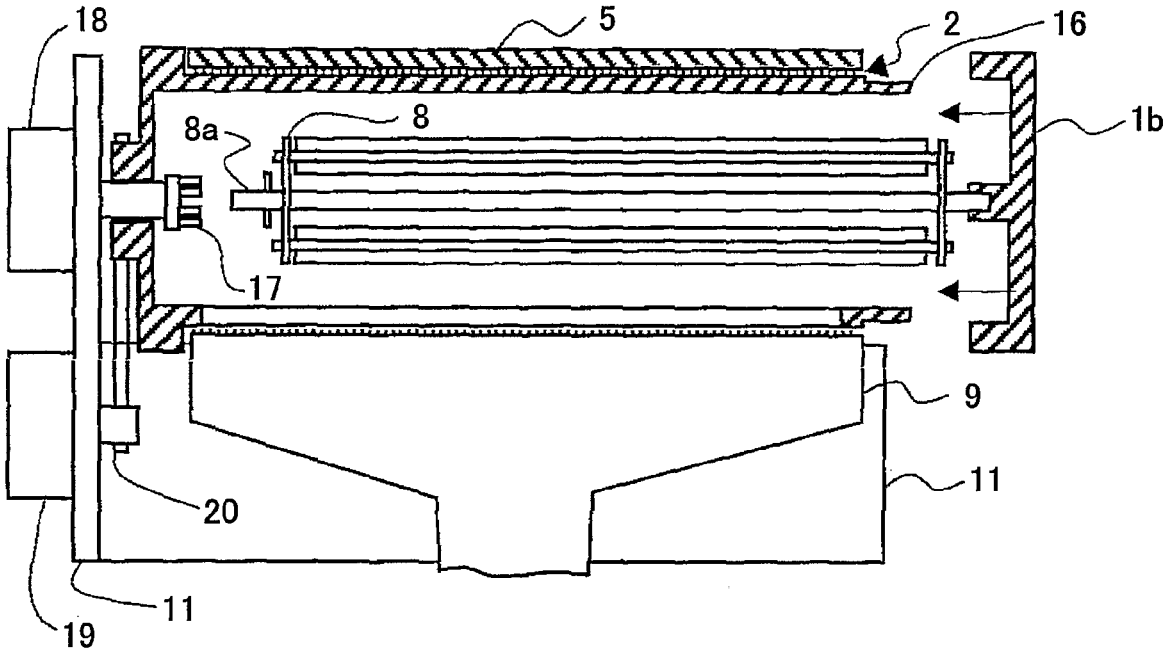
FIG. 10 is a front sectional view of the third embodiment.

FIG. 10 is a front sectional view of the third embodiment. FIG. 10 shows a work holding rotating nail unit 17, a work holding unit rotating motor 18, a mesh rotating motor 19, and a mesh driving belt 20.

The inner tube 16 and the mesh 2 are made to rotate by the mesh rotating motor 19 fixedly mounted on the base plate 11 and the mesh driving belt 20.

The aspiration duct 9 is fixedly mounted on the base unit of the apparatus, and is connected to the opening of the mesh cover 5 to hold the mesh cover 5. The end of the aspiration duct 9 is coupled to a dust collecting unit (not shown) including a negative pressure generating means such as an aspiration blower having a filter for capturing and collecting dust. Through the operation of the dust collecting unit, dust inside the cleaning tank 10 is sucked out.

The inlet 4*a* (the same as that shown in FIG. 9B, and not shown in FIG. 10) situated alongside the aspiration duct 9 has a plurality of air blow nozzles N installed therein serving as a blowing unit. In this embodiment, as in the previous embodiment, the aspiration opening 3*a* and the inlet 4*a* are situated side by side, which makes it possible to position the cleaning agent M reliably at the air blow of the blow unit before the cleaning agent M attracted to the mesh by the aspiration unit spontaneously separates from the mesh. This makes it possible to make the cleaning agent M fly at high speed so as to improve cleaning quality and cleaning efficiency.

Figure 11A:
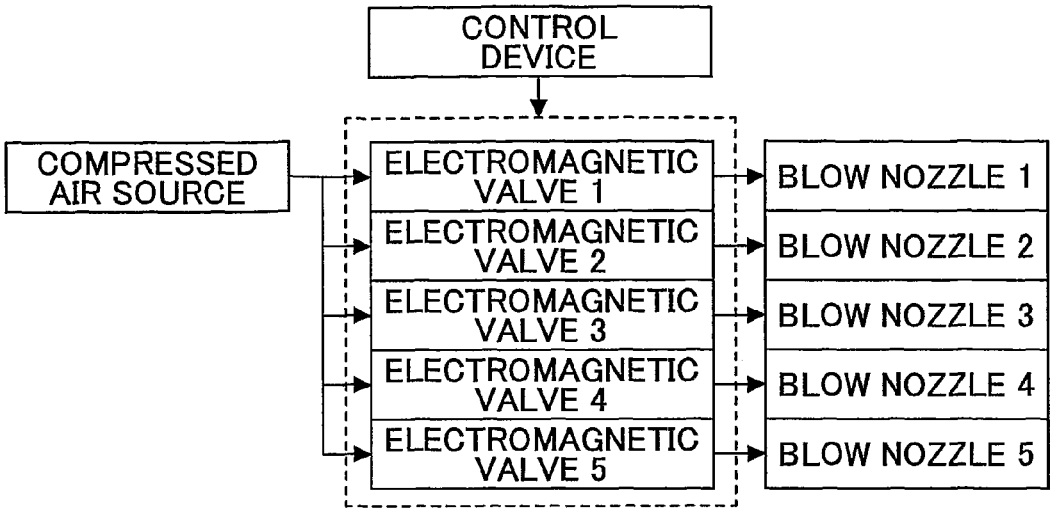
FIGS. 11A through 11C are drawings for explaining the operation timing of air blow nozzles.
Figure 11B:
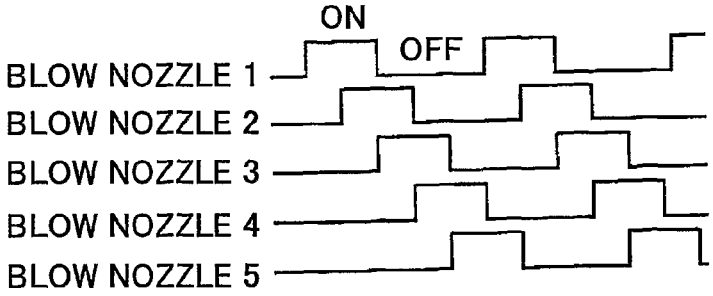
Figure 11C:
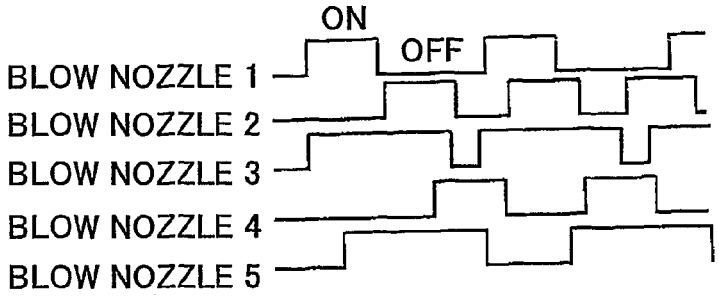

FIGS. 11A through 11C are drawings for explaining the operation timing of the air blow nozzles N. FIG. 11A shows the configuration of the control unit. FIG. 11B shows an example of a timing chart. FIG. 11C shows another example of a timing chart.

As shown in FIG. 11A, each of the air blow nozzles N is connected to an electromagnetic valve that is independent from other valves serving as switching means. The control device supplies signals to change the combination, order, and timing of the operations of the air blow nozzles N. FIGS. 11B and 11C illustrate the control pattern of air blows. In order to improve cleaning efficiency, all the air blow nozzles N should be operated simultaneously. In such a case, however, a large compressed air source is required such as to match the size of work when the work is relatively large or of long size, which results in a cost increase. Further, the aspiration blower for keeping a negative pressure inside the cleaning tank 10 also needs to have a higher capacity. This ends up increasing the consumption of energy and the costs of facility. In consideration of this, the operation of each air blow nozzle N, i.e., the blowing of air, may be performed in a time-sharing manner.

FIG. 11B shows an example in which the air blow nozzles N are successively operated from the first one in the sequential order, with an equal duration of each air blow. Provision is made such that after the last one (air blow nozzle 5) in the line is operated, the first one (air blow nozzle 1) is operated again. The ratio of the operating time to the waiting time may be determined by taking account the power of the compressed air source.

FIG. 11C shows an example in which the operating time (the duration of an air blow) is changed for each of the air blow nozzles N. The longer the duration of air blow, the faster the circulation of the cleaning agent M. Thus, an air blow nozzle N corresponding to an area that requires through cleaning is preferably operated for a long time.

The configuration described above is directed to an example in which the timing of air blow of the air blow nozzles N is changed. Alternatively or additionally, provision may be made such that the power of air blow is changed for each of the air blow nozzles N. An air blow nozzle N corresponding to an area that requires through cleaning is preferably set to a strong air blow power, thereby providing uniform cleaning effects. The adjustment of air blow strength may be achieved by use of a flow control valve.

In the configuration described above, the larger the number of air blow nozzles N operated simultaneously, the faster the circulation of the cleaning agent M is. In consideration of this, the number of air blow nozzles N operated simultaneously may be set to a small number at the beginning of cleaning so as to remove extraneous substance with weak adherence, and the number of air blow nozzles N operated simultaneously may be increased as a finish at the end of the cleaning, thereby removing extraneous substance with strong adherence. In this case, the amount of air consumption is reduced so as to lower the consumption of energy.

These control patterns may be switched to conform to the work W to be cleaned. Thus, different items of work W can be dealt with by switching the software programs. Switching during the ongoing cleaning process makes it possible to change the movement of the cleaning agent M in a complex manner, which provides for the work of relatively complex shape to be cleaned properly without leaving an unclean part.

In the embodiment described above, a corona-discharging-type discharge unit (not shown) may be provided alongside the air blow nozzles N or embedded inside the air blow nozzles N.

The lid portion 1*b* engages the inner tube 16 in a loose manner, which allows the work W to be put into or taken out of the cleaning tank 10.

The work holding unit 8 includes four arms extending radially from the center axis 8*a*, and further includes a ring member connected to the tip of each arm. This configuration can hold four items of the work W in a rotatable manner. The ring member supports the axial portion of the work at each end thereof. Since the inner diameter of the ring member is larger than the outer diameter of the axial portion of the work, the work can spin within the ring.

The work holding unit rotating motor 18 is fixedly mounted on the base plate 11, and has a shaft that extends into the cleaning tank 10 through an opening provided at the center of the inner tube 16. One end of the rotation axis 8*a* of the work holding unit 8 fits into a hole formed at the tip of the shaft of the work holding unit rotating motor 18, and the opposite end of the rotation axis 8*a* fits into a boss formed on the cleaning tank (lid portion 1*b*). The rotation of the work holding unit rotating motor 18 causes the work holding rotating nail unit 17 to revolve, so that the work W rotates with the work holding unit 8. The shape of the cleaning agent M and other aspects are the same as in the previous embodiments.

In the following, the operation of the cleaning apparatus will be described. The work W is mounted to the work holding unit 8. The lid portion 1*b* and the inner tube 16 are fit together, with the work holding unit 8 being attached to the lid portion 1*b*. This operation places the work W inside the cleaning tank 10.

The aspiration blower of the dust collecting unit is activated to create a negative pressure inside the cleaning tank 10, and the mesh rotating motor 19 is activated to rotate the inner tube 16 and the mesh 2, which starts the high-speed flight of the cleaning agent M inside the cleaning tank 10. The mechanism of the cleaning process is basically the same as that of the first embodiment and the second embodiment.

The operation of the air blow nozzles N can increase the speed of air currents inside the cleaning tank 10 so as to improve cleaning performance. Further, the combination and timing of the operations of the air blow nozzles N may be changed to create complex air currents inside the cleaning tank 10, thereby causing the cleaning agent M to contact or impact all the surfaces of the work W to be cleaned.

In this embodiment, the work holding unit rotating unit serves to cause the work W to rotate (rotate around an external reference point) and spin (rotate around itself), thereby causing the cleaning agent M to contact or impact all the surfaces of the work W to be cleaned. This achieves high cleaning quality without leaving any unclean parts. Further, the work holding unit 8 reliably holds the work W, so that the items of the work W do not collide with each other during the cleaning process to cause any damage or scratching.

When the mesh rotating motor 19 is stopped after a predetermined period of cleaning, the cleaning agent pieces M that were flowing inside the cleaning tank 10 gather on the mesh unit. The discharge unit may be operated at this point in time, so that the cleaning agent pieces M attached to the work W are also removed from the work W to gather on the mesh unit. The air blow and the aspiration blower of the dust collecting unit are then stopped, followed by removing the lid portion 1*b* from the inner tube 16, then taking the cleaned work W off of the work holding unit 8.

Fourth Embodiment

Figure 12:
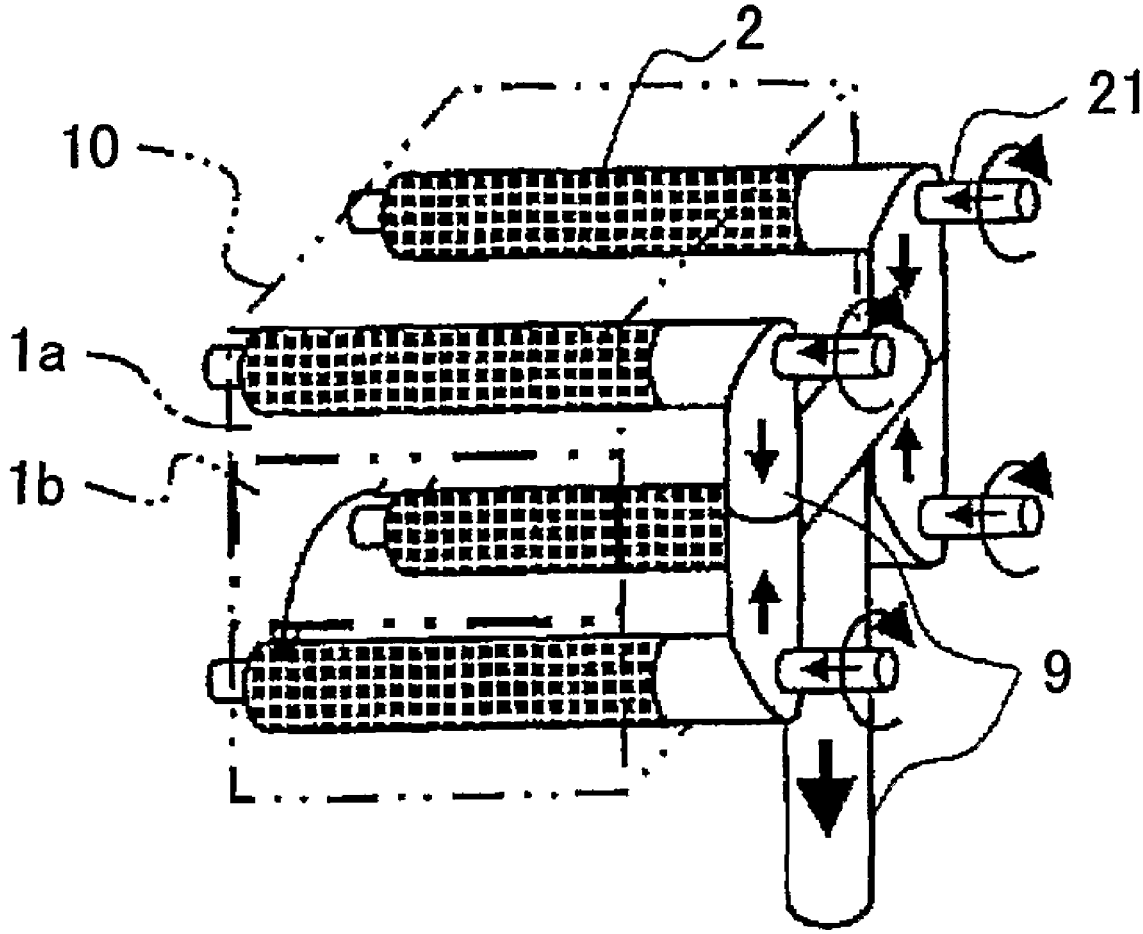
FIG. 12 is a perspective view for explaining the configuration of a fourth embodiment of the present invention.
Figure 13A:
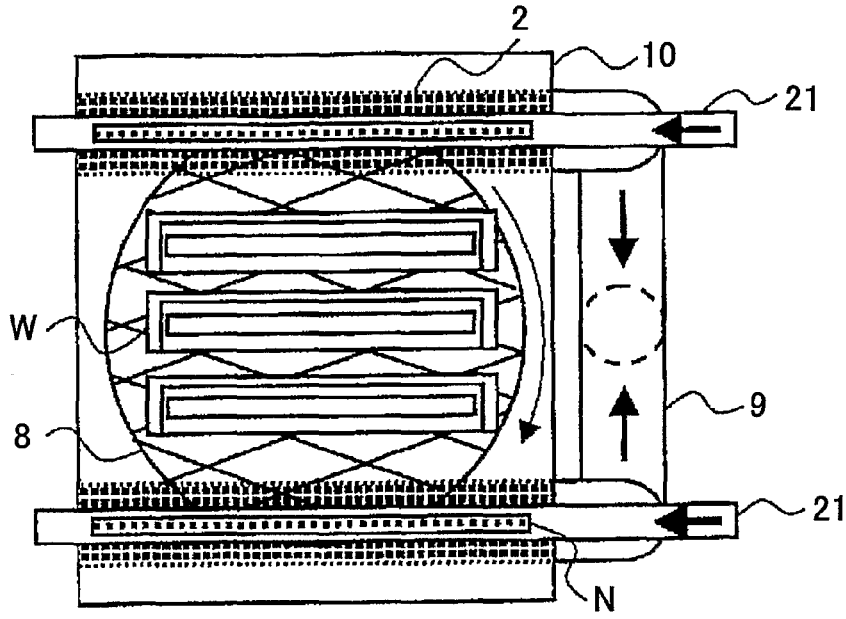
FIGS. 13A through 13B are partial cross-sectional views of the fourth embodiment.
Figure 13B:
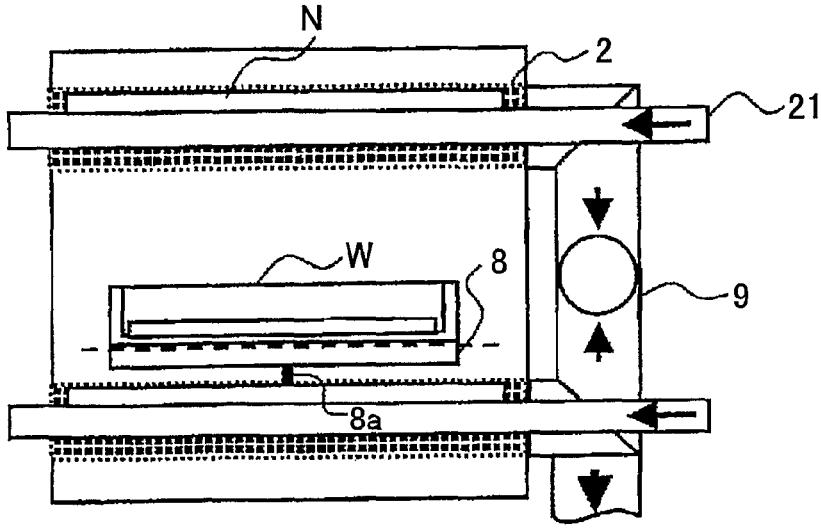
Figure 14:
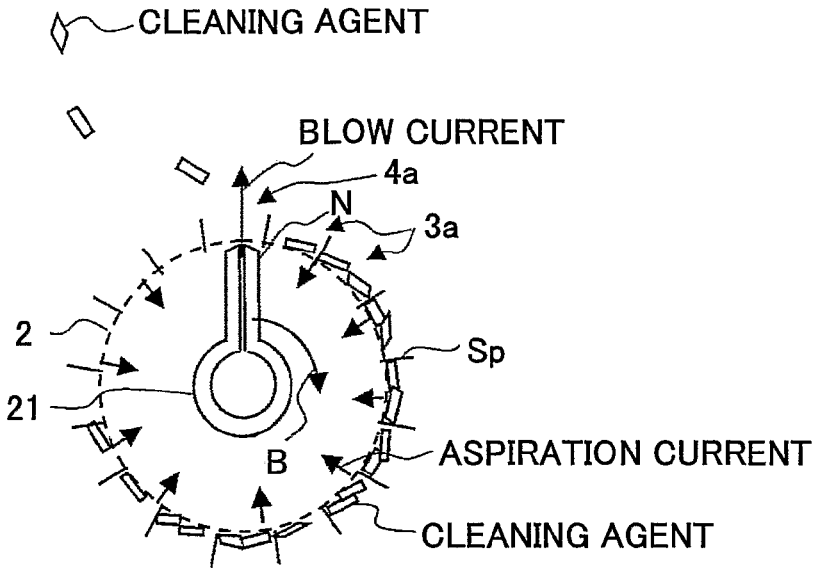
FIG. 14 is a cross-sectional view of a cylindrical mesh and an air blow nozzle.

FIG. 12 is a perspective view for explaining the configuration of a fourth embodiment of the present invention. FIGS. 13A through 13B are partial cross-sectional views of the fourth embodiment. FIG. 13A shows a plan view, and FIG. 13B shows a side view. FIG. 14 is a cross-sectional view of a cylindrical mesh and an air blow nozzle N. In each figure, reference numeral 21 represents a blow supply duct. In the following, the configuration of this embodiment will be described.

The work supporting table 8 serving as a work holding member and four double cylindrical tube meshes are disposed inside the cleaning tank 10 of rectangular solid. The side wall portion 1*a* of the cleaning tank 10 is provided with the lid portion 1*b* serving as a work inlet and outlet.

The work supporting table 8 comprised of a coarse mesh that allows the cleaning agent M to pass through with ease is configured to be rotatable around the rotation axis 8*a* by a rotation drive unit (not shown) such as a motor. The rotation drive unit (not shown) may be disposed inside the cleaning tank 10. It is preferable, however, to dispose the rotation drive unit outside the cleaning tank 10 in order to avoid malfunction due to the dusty environment. For example, a hole slightly larger than the rotation axis 8*a* of the work supporting table 8 may be formed through the bottom of the cleaning tank 10, and a rotational force from the rotation drive unit may be transmitted through the hole. The aspiration unit 3 creates a negative pressure inside the cleaning tank 10, so that an air current moving into the cleaning tank 10 is generated at a gap between the rotation axis 8*a* and the hole. The cleaning agent M and dust thus do not leak to outside the cleaning tank 10.

The mesh 2 serving as a separation unit is a cylindrical, mesh having holes that do not allow the cleaning agent M to pass through. The partitions Sp of rib or fin shape are formed outside the perimeter of the cylindrical mesh 2 (on the side where the work W is situated). The ribs or fins are configured such that their intervals are winder than the size of the cleaning agent pieces M. The provision of the partitions Sp on the mesh 2 achieves the same effects as achieved by extending the nozzle of the blow unit, thereby being able to accelerate the cleaning agent M by preventing the spread of an air current, and being able to prevent the cleaning agent M from returning to the aspiration opening 3*a* without flying in the air current blowing through the inlet 4*a*. In this configuration, the portion of the mesh at which the air blow nozzle N is aimed corresponds to the inlet 4*a*, and all the other mesh portions correspond to the aspiration opening 3*a*. The provision of the partition Sp causes the cleaning agent M to fly at higher speed inside the cleaning tank 10 than in the case where no such provision is made, and also achieve reliable circulation, thereby achieving higher cleaning quality and higher cleaning efficiency.

An array of the air blow nozzles N serving as a blow unit is disposed inside the cylindrical mesh 2 to extend in the axial direction of the cylinder. The array is rotated by a rotating unit (not shown), and is coupled via a rotational joint to the blow supply duct 21 connected to an electromagnetic valve and compressed air source. The tips of the air blow nozzles N are positioned in close proximity to the inner surface of the cylindrical mesh, and rotate without touching the mesh 2 In this embodiment, the tips of the air blow nozzles N also serve as an inlet for allowing air to flow into the cleaning tank 10. The inlet 4*a* is made to shift its position while the mesh 2 stays still, thereby preventing the cleaning agent M to clog the mesh 2. The movement of the air blow nozzles N may be continuous rotation in one direction. Since the cleaning effect is small if the high-speed air current is made to blow toward the direction of space where no work to be cleaned is placed, the movement of the air blow nozzles N may be a swinging movement that generally directs the air current toward the work to be cleaned. In this case, the portion of the mesh which the outlets of the air blow nozzles N do not face may be covered with a mesh cover so as to prevent the cleaning agent M to be attracted thereto.

The aspiration duct 9 coupled to a negative pressure source (dust collecting apparatus: not shown) is divided into four ducts, each of which is connected to a double cylindrical tube mesh. A portion of the aspiration duct 9 has a hole through which the blow supply duct 21 passes through. Air squirting from the air blow nozzles N after passing through the blow supply duct 21 blows into the cleaning tank 10 through the mesh 2, and is then sucked through the portions of the mesh 2 other than the position of the inlet 4*a* for transmission to the aspiration duct 9. In this configuration, only the portion of the cylindrical mesh 2 which the air blow nozzles N face serves as the inlet 4*a*, and the other portions serve as the aspiration opening 3*a*. In this embodiment, aspiration and blow are provided from the right-hand side, with the left-hand side end of the mesh 2 and the blow supply duct 21 being closed. Additionally, aspiration (negative pressure) and blow (positive pressure) may as well be provided from the left-hand side.

The lid portion 1*b* operable to open and close is provided on the side wall portion 1*a* of the cleaning tank 10, thereby allowing the work W to be put into and taken out of the cleaning tank 10. The cleaning agent M inside the cleaning tank 10 can be used repeatedly without replacement.

In the following, the operation of the cleaning apparatus will be described. The work W with attached dust is placed on the work supporting table 8 inside the cleaning tank 10. If the weight of the work W is light in comparison with the speed of air currents inside the cleaning tank 10, the work W is fixed to the work supporting table 8.

After the work W is placed, aspiration by the dust collecting apparatus and the rotation and air blow of the air blow nozzles N are started. The cleaning agent M accumulated at the bottom of the cleaning tank 10 is made to fly inside the cleaning tank 10 by the air blow, and then hits the work W to be cleaned to remove the dust attached to the surfaces of the work W. Among the dust removed from the surfaces of the work W, dust floating inside the cleaning tank 10 passes through the mesh 2 to be sucked into the aspiration duct 9. The cleaning agent M flying inside the cleaning tank 10 is attracted and attached to the portion of the mesh 2 serving as the aspiration opening 3*a*, with its dust being removed due to the high-speed aspiration current passing through the mesh. The cleaning agent M attached to the mesh is blown off by the high-speed air current squirting from the air blow nozzles N as the relevant mesh portion changes into the inlet 4*a* due to the rotation of the air blow nozzles N. The cleaning agent M thus flies again inside the cleaning tank 10.

In this embodiment, a unit for changing the position of the work (the rotating work supporting table) is provided to clean the work W while rotating same. Further, the cylindrical meshes 2 and the arrays of air blow nozzles N are disposed at four different positions corresponding to the top left, top right, bottom left, and bottom right corners around the work W, and the cleaning agent pieces M are blown in radial directions while changing the direction of the air blow nozzles N of each mesh 2. With this provision, it is possible to subject the work W to the air currents and cleaning agent pieces M coming from various directions, thereby making it possible to clean the work W properly and uniformly even if the work W has a relatively complex shape.

Similarly to the third embodiment, the combination and timing of the operations of the four arrays of air blow nozzles may be changed, and the speed and direction of the rotation may also be changed, thereby creating complex air currents inside the cleaning tank 10. This makes it possible to subject the work W to the air currents and the cleaning agent pieces M coming from various directions, thereby further improving cleaning quality.

A discharge blow may be operated during or after the cleaning process to remove the cleaning agent M attached to the work W, and, then, the cleaned work W is taken out.

Fifth Embodiment

Figure 15:
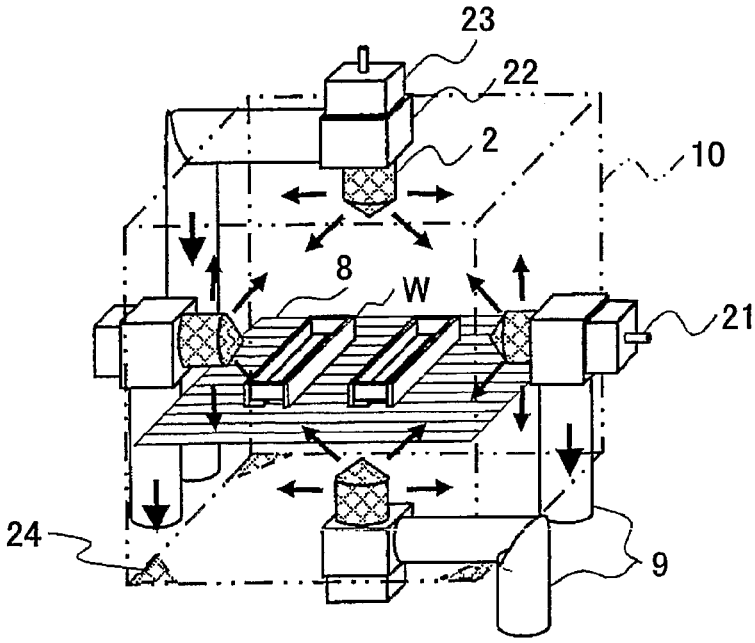
FIG. 15 is a perspective view for explaining a fifth embodiment of the present invention.

FIG. 15 is a perspective view for explaining a fifth embodiment of the present invention. FIG. 15 shows a nozzle base 22, a nozzle rotating unit 23, and a mesh-attached opening 24 serving as an inlet. In the following, the configuration of this embodiment will be described.

As shown by chain lines in FIG. 15, the work supporting table 8 is disposed inside the cleaning tank 10 of rectangular solid, and cone/cylindrical mesh-attached nozzles are provided at the top, bottom, left, and right of the cleaning tank 10. At the four corners of the bottom of the cleaning tank 10, the mesh-attached openings 24 are provided to allow the intake of air from the exterior when a negative pressure is created inside the cleaning tank 10. This makes it possible to circulate the cleaning agent M inside the cleaning tank 10 without allowing the cleaning agent M to stay at the corners of the cleaning tank 10. The work supporting table 8 is comprised of a coarse mesh that allows an easy passage of the cleaning agent M, and supports the work W placed thereon.

Figure 16A:
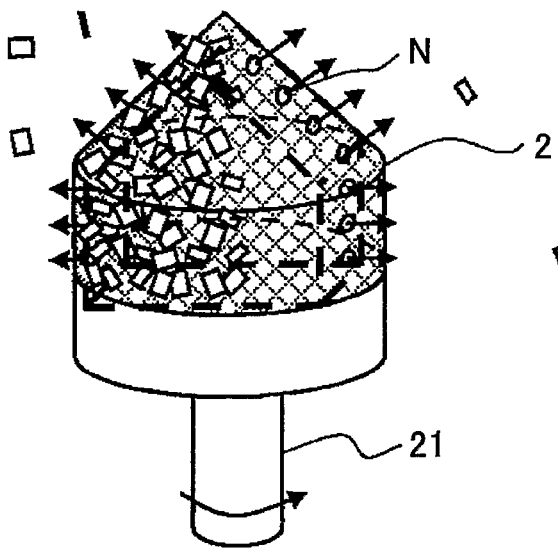
FIGS. 16A and 16B are perspective views of cone/cylindrical-mesh-attached nozzles.
Figure 16B:
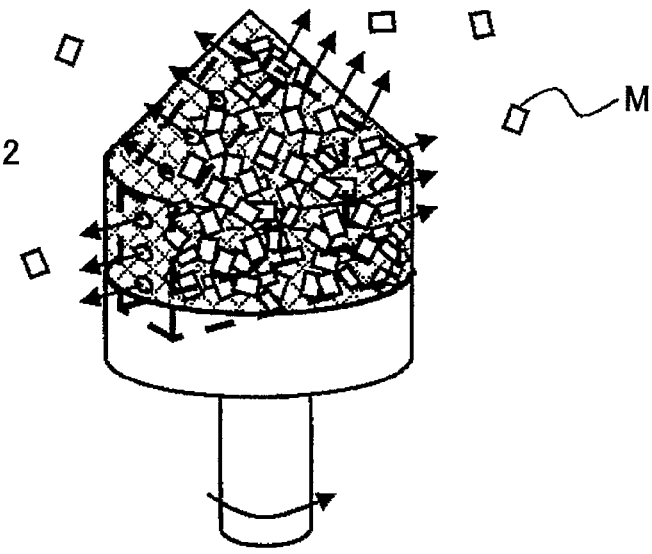
Figure 17A:
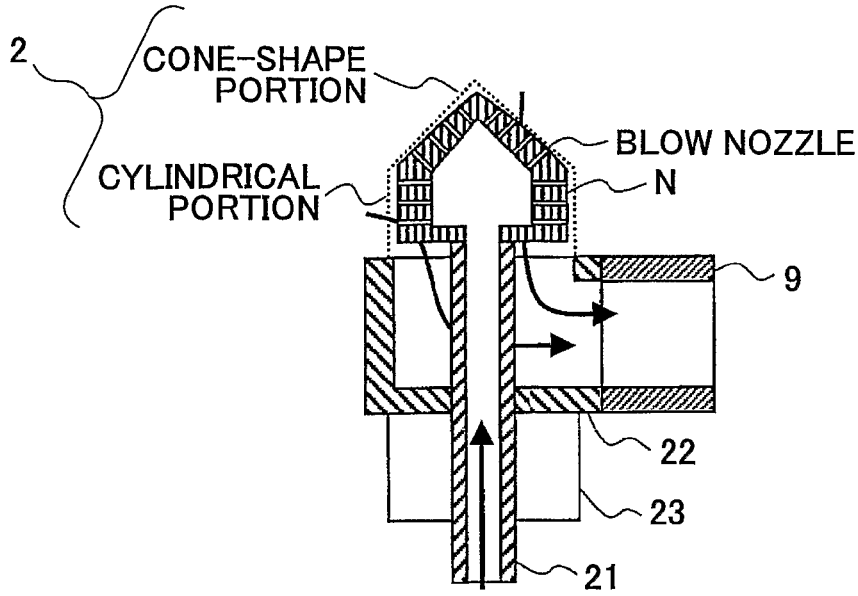
FIGS. 17A and 17B are drawings showing the detail of the cone/cylindrical-mesh-attached nozzles.
Figure 17B:
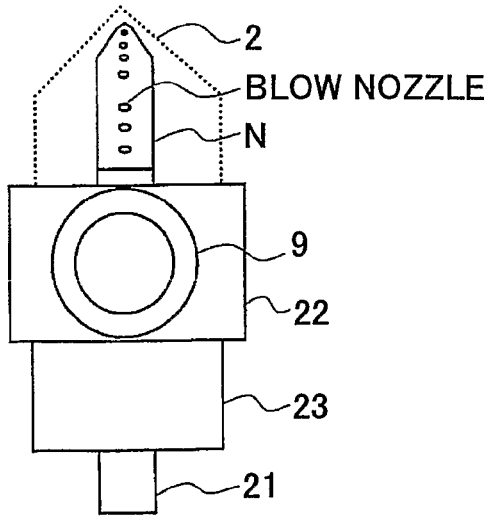

FIGS. 16A and 16B are perspective views of cone/cylindrical-mesh-attached nozzles. FIG. 16A and FIG. 16B are views for illustrating the different states of rotating nozzles in terms of their positions. FIGS. 17A and 17B are drawings showing the detail of cone/cylindrical-mesh-attached nozzles. FIG. 17A is a sectional side view, and FIG. 17B is a front view of the aspiration duct.

The air blow nozzles N are arranged in direct contact with the inner surface of the mesh 2 that includes a cone-shape mesh portion and cylindrical mesh portion. The air blow nozzles N are connected to the blow supply duct 21 coupled to a compressed air source. In this embodiment, the tips of the air blow nozzles N also serve as an inlet for allowing air to flow into the cleaning tank 10. The inlet 4*a* is made to shift its position while the mesh 2 stays still, thereby preventing the cleaning agent M to clog the mesh 2. In this embodiment, as in the fourth embodiment, all the portions of the mesh 2, except for the portion serving as the inlet 4*a*, serve as the aspiration opening.

The mesh 2 is comprised of a cone-shape mesh and a cylindrical mesh fixedly mounted on the nozzle base, and covers the air blow nozzles N. The mesh 2 does not allow the cleaning agent M to pass through while allowing dust to pass through.

The blow supply duct 21 is supported by the nozzle rotating unit 23 in a rotatable manner. Provision is made such that the blow supply duct 21 is rotated to rotate the air blow nozzles N. A mortar having a hollow shaft may be used as the nozzle rotating unit 23. The blow supply duct 21 is coupled to the compressed air source via a rotational joint (not shown).

The nozzle base 22 that conducts a negative pressure from the aspiration duct 9 to the interior of the mesh 2 supports the mesh 2 and the nozzle rotating unit 23. The aspiration duct 9 is coupled to a dust collecting apparatus (i.e., a filter-attached aspiration blower for collecting dust: not shown).

In the following, the operation of the cleaning apparatus will be described. As the negative pressure is created inside the aspiration duct 9 by the dust collecting apparatus to make a negative pressure inside the cleaning tank 10, air flows into the cleaning tank 10 through the mesh at the bottom of the cleaning tank 10, thereby blowing up the cleaning agent M. The air blow nozzles N squirt air and rotate, so that the cleaning agent M flies and circulates at high speed inside the cleaning tank 10 while contacting or impacting the work W to be cleaned.

The mechanism of the cleaning process is basically the same as that of the previous embodiments. The use of the nozzles of the present embodiment causes the cleaning agent M to fly radially (in hemispherical space) as time passes, so that a small number of nozzles can achieve efficient cleaning. Although in this embodiment a means to change the position of the work W (to be cleaned) is not illustrated, the work position changing unit the same as that used in the fourth embodiment may be used. Further, the partitions Sp of rib shape similar to the one used in the fourth embodiment may be formed outside the cone-shape portion and cylindrical portion of the mesh 2.

A disk-shape mesh is described as an example in the first embodiment, and a cylindrical separation unit (mesh) is described as an example in the third embodiment, with these meshes being rotated to exhibit relative motion with respect to the inlet and the aspiration opening. Alternatively, a mesh of plane shape or belt shape may be made to move in tandem so as to exhibit relative motion with respect to the inlet and the aspiration opening. The inlet (or air blow nozzles N) is rotated to exhibit relative motion with respect to the mesh in the second and fourth embodiments. Alternatively, the inlet (or air blow nozzles N) may be made to move in tandem so that the mesh exhibits relative motion with respect to the inlet and the aspiration opening. In the fifth embodiment, the separation unit (mesh) includes a corn-shape portion attached to one end of a cylindrical portion. Alternatively, the separation unit may have a simple cylindrical shape or hemispherical shape. In such a case, the shape of the air blow nozzles N should be arranged to conform to the shape of the mesh.

In the following, variations of the present invention will be described. In the first through fifth embodiments described above, the separation unit is made to exhibit relative motion with respect to the inlet and the aspiration opening so as to cause the cleaning agent attached to the separation unit to fly in the air again. In first and second variations which will be described in the following, the operating conditions of the air current generating unit is switched to cause the cleaning agent attached to the separation unit to fly in the air again.

Figure 18:
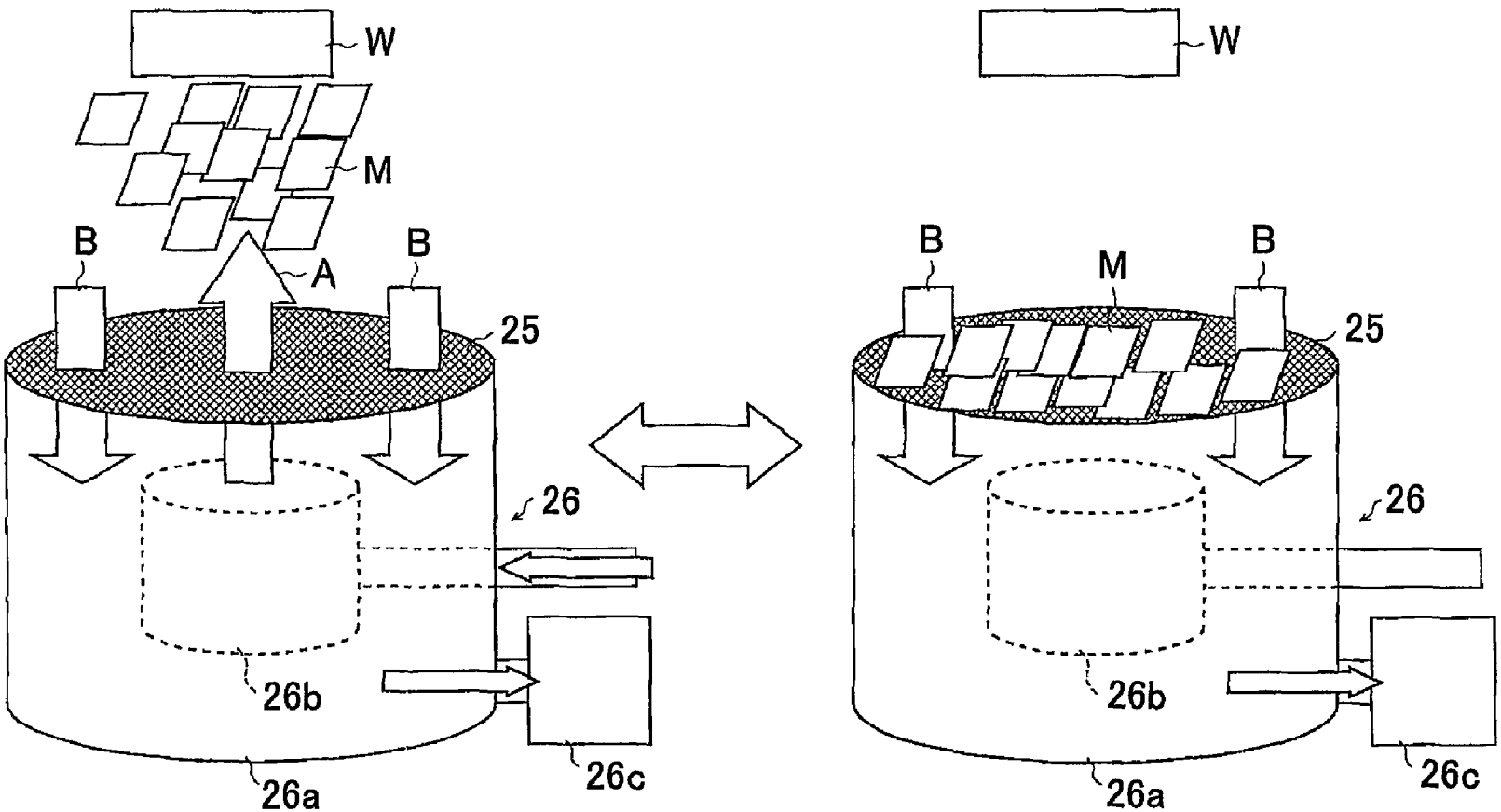
FIG. 18 is a drawing showing the first variation of the present invention.

FIG. 18 is a drawing showing the first variation of the present invention. FIG. 18 shows a mesh 25 serving as a separation unit, an air current generating unit 26, cleaning agent M, and work W to be cleaned. In the configuration shown in FIG. 18, a cleaning tank is not provided. The work W is supported by a holding unit (not shown) that is situated above the mesh 25. The same cleaning agent M that was used in the previously described embodiments may be used. Namely, the cleaning agent M may include resin beads, various blast projection materials, brush rolls, sponge balls, thin pieces (i.e., resin film pieces, thermal plasticity elastomer film pieces, cloth pieces, ceramic pieces, paper pieces, metal film pieces, or the like having an area size of 1 to 1000 $mm^2$ and a thickness of 1 to 500 micrometers).

The air current generating unit 26 includes a main structure 26*a*, a blowing unit 26*b*, and an aspiration unit 26*c*. The main structure 26*a* has a cylindrical shape with an open top. The open top is provided with the mesh 25 that has the same structure as the mesh 2 as previously described. That is, the mesh 25 has a large number of holes or slit openings that allow the dust attached to the work W to pass through while not allowing the cleaning agent M to pass through. The blowing unit 26*b* is coupled to a compressor (not shown), and sends air upwards from the blower opening. The aspiration unit 26*c* is coupled to an aspiration blower (not shown) to suck in air from inside the main structure 26*a*. The air that is used by the air current generating unit 26 to generate an air current is not limited to air, but includes nitrogen gas, carbon-dioxide gas, inactive gas such as argon gas, or any other proper gas. The speed of the air current generated by the air current generating unit 26 may preferably set equal to or more than 5 m/s in order to make the cleaning agent M fly properly.

In the following, the operation of the first variation will be described.

As the compressor (not shown) is activated, an upward air current A is generated by the blowing unit 26*b*, and carries the cleaning agent pieces M upwards in the air. The flying cleaning agent pieces M impact the work W, thereby removing dust attached to the work W. The removed dust particles include those which fly in the air and those which are attached to the cleaning agent pieces M. When the compressor (not shown) is stopped after a predetermined time period, the dust scattered in the air is carried by a downward air current B generated by the aspiration unit 26*c* as it is activated, resulting in being sucked into the main structure 26*a* through the mesh 25. The dust attached to the cleaning agent pieces M are beat off by the impact of the cleaning agent pieces M against the mesh 25 as the cleaning agent pieces M are attracted to the mesh 25 by the air current B, resulting in being sucked into the main structure 26*a*.

As this aspiration state continues, the mesh 25 ends up being fully covered with the cleaning agent M, resulting in a reduced aspiration power and reduced cleaning performance. After a predetermined time period, the compressor (not shown) is activated again to generate the air current A. The cleaning agent M adhering to the mesh 25 is thus made to fly towards the work W. In this manner, the cleaning agent M cleans the particles attached to the work W, and also has the particles attached to itself cleaned by the mesh 25, thereby repeating a recycling circulation. In this embodiment, the portion of the mesh 25 where the air current A passes through serves as an inlet, and the portion where the air current B passes through serves as an aspiration opening.

In this embodiment, the cleaning agent flying to clean the work is made to fly and clean the work repeatedly while cleaning itself, so that even if the work has a complex shape, it is possible to improve cleaning quality and cleaning efficiency without damaging the work. Further, the amount of the cleaning agent used is reduced to lower the running cost significantly.

Figure 19:
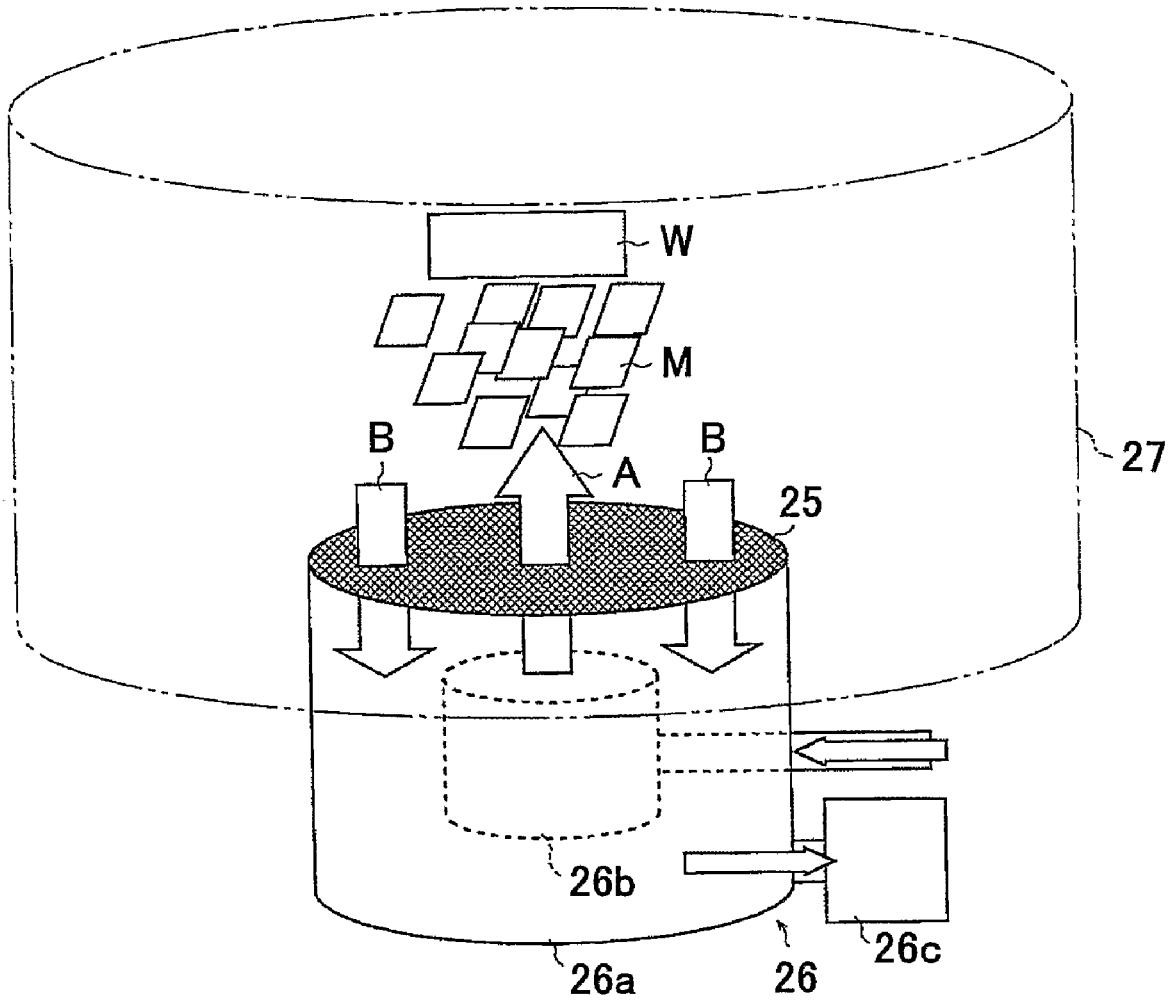
FIG. 19 is a drawing showing a modified example of the first variation of the present invention.

FIG. 19 is a drawing showing a modified example of the first variation of the present invention. This modified example differs from the first variation in that a cleaning tank 27 is provided above the air current generating unit 26, and is connected to the main structure 26*a*, with the work W being supported by the holding unit (not shown) inside the cleaning tank 27. Other structural details are the same. The cleaning tank 27 has a cylindrical shape with an opening at the bottom surface thereof. The main structure 26*a* is fit into the opening, so that the interior space of the cleaning tank 27 is sealed.

In this modified example, the operation of the compressor (not shown) is controlled in the same manner as in the first variation, so that the flying cleaning agent M collides with the work W in the same manner as in the first variation, thereby removing dust from the work W. The cleaning agent M is cleaned when the adhering dust received from the work W is beat off upon impact to the mesh 25, and is made to fly again by the air current generating unit 26 to clean the work W again.

According to this modified example, the aspiration of air from excess space unrelated to the cleaning of the work W is avoided, thereby improving the efficiency of dust aspiration, and also preventing the removed dust from being scattered to the surrounding area by the air current A. This significantly improves cleaning efficiency.

Figure 20:
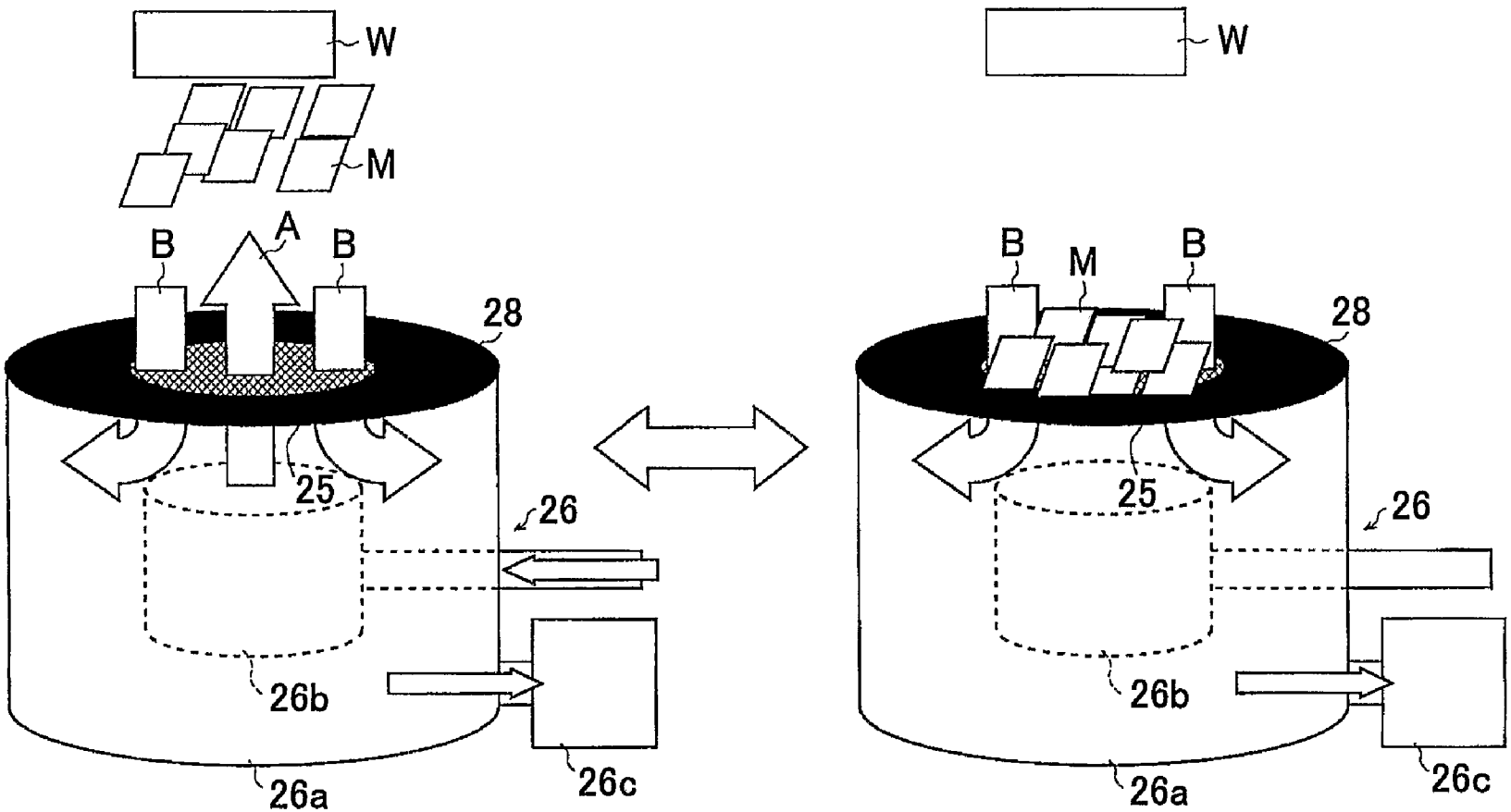
FIG. 20 is a drawing showing another modified example of the first variation of the present invention.

FIG. 20 is a drawing showing another modified example of the first variation of the present invention. This modified example differs from the first variation in that a mask member 28 is disposed on the mesh 25. Other structural details are the same. The mask member 28 of disk donut shape has an opening at the center thereof, the size of which is set to correspond to the area size of the air current A blowing from the blowing unit 26*b*.

In this modified example, the operation of the compressor (not shown) is controlled in the same manner as in the first variation, so that the cleaning agent M is made to fly repeatedly to clean the work W in the same manner as in the first variation. In this modified example, the cleaning agent M is prevented from being attracted to the portion of the mesh 25 where the air current A does not reach, and thus failing to fly again. This thus ensures that all the cleaning agent pieces M contribute to the cleaning of the work W, resulting in the utilization of the cleaning agent pieces M being improved to enhance the cleaning efficiency.

Figure 21:
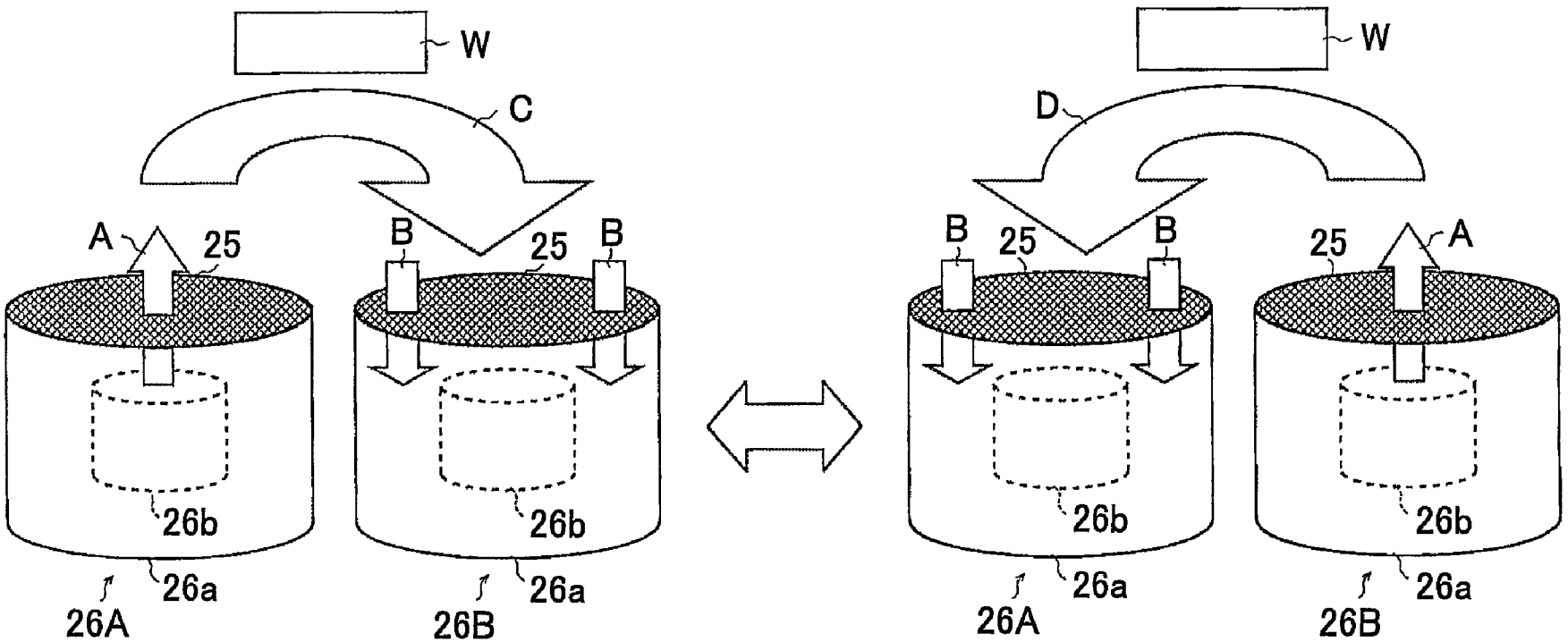
FIG. 21 is a drawing showing the second variation of the present invention.

FIG. 21 is a drawing showing the second variation of the present invention. The second variation differs from the first variation described above in that a plurality of air current generating units 26 are provided and arranged side by side, with the operations of these units being switched. Other structural details are the same.

In the example shown in FIG. 21, two air current generating units 26A and 26B are arranged side by side. When the air current generating unit 26A generates the air current A, the air current generating unit 26B generates the air current B. This generates an air current C above the air current generating units 26A and 26C, so that the cleaning agent M carried airborne by the air current C cleans the work W. After a predetermined time period, the operations of the air current generating units 26A and 26B are controlled such that the air current generating unit 26A generates the air current B, and the air current generating unit 26B generates the air current A. This creates an air current D moving in the opposite direction to the air current C above the air current generating units 26A and 26B, so that the cleaning agent M having been carried by the air current C from the air current generating unit 26A to the air current generating unit 26B is made to fly again to clean the work W.

Figure 22:
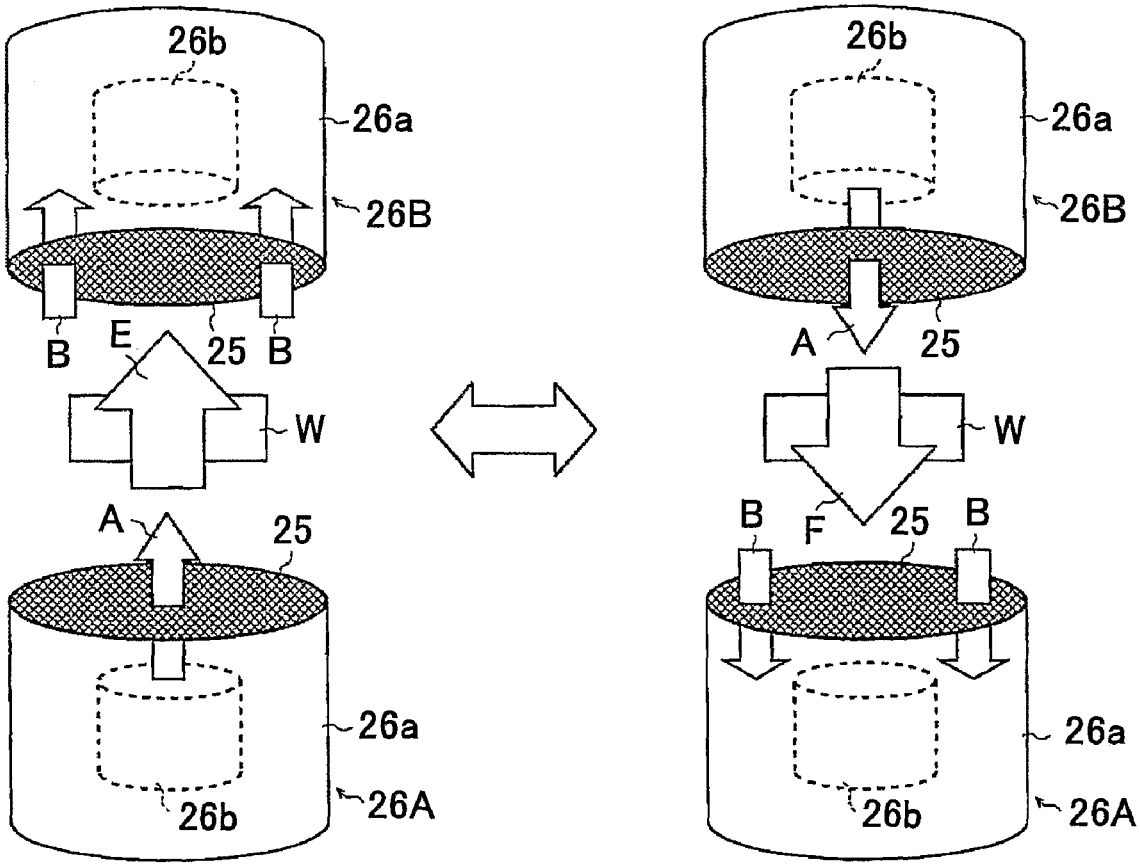
FIG. 22 is a drawing showing a modified example of the second variation of the present invention.

According to the second variation, the cleaning agent M flies between the air current generating units 26A and 26B, so that arranging the air current generating units by taking into account the shape and position of the work W makes it possible to clean the work W thoroughly, thereby improving cleaning quality and cleaning efficiency. In the variation described above, the air current generating units 26A and 26B are arranged side by side to generate the air current C or the air current D between the air current generating units 26A and 26B. Alternatively, the air current generating units 26A and 26B may be arranged to face each other as shown in FIG. 22 so as to generate an air current E or an air current F between the air current generating units 26A and 26B, thereby causing the air currents E and F to clean the work W.

Further, the present invention is not limited to these embodiments, but various variations and modifications may be made without departing from the scope of the present invention.

The cleaning apparatus described above may be used to perform dry cleaning with respect to products or components with attached dust, thereby reducing the environmental load associated with the cleaning process at the time of manufacturing or recycling the products or components.

Although the present invention has been described with reference to embodiments, the present invention is not limited to these embodiments, but various variations and modifications may be made without departing from the scope of the invention as set forth in the accompanying claims.

The present application is based on Japanese priority applications No. 2005-182168 filed on Jun. 22, 2005 and No. 2006-053852 filed on Feb. 28, 2006 with the Japanese Patent Office, the entire contents of which are hereby incorporated by reference.

The invention claimed is:

1. A dry cleaning apparatus which causes cleaning agent to fly in a gas current to impact an object to be cleaned so as to remove extraneous substance attached to the object, comprising:

a cleaning tank defining an interior space for accommodating the cleaning agent and the object with the attached extraneous substance;

an inflow unit configured to guide a gas current into the cleaning tank through an inlet;

an aspiration unit configured to discharge gas from the cleaning tank through an aspiration opening; and a separation unit disposed between the interior space of the cleaning tank and both the inflow unit and the aspiration unit, said separation unit having openings that allow the gas and the extraneous substance to pass through but do not allow the cleaning agent to pass through, wherein the inlet, the aspiration opening, and the separation unit are configured such that relative motion is created between the separation unit and both the inlet and the aspiration opening.

2. The dry cleaning apparatus as claimed in claim 1, wherein the relative motion is configured such that the aspiration opening first comes to a point of interest on the separation unit, and, then, the inlet comes to the point of interest on the separation unit.

3. The dry cleaning apparatus as claimed in claim 1, wherein the separation unit is at least one surface of the cleaning tank.

4. The dry cleaning apparatus as claimed in claim 3, wherein the separation unit has a plane shape.

5. The dry cleaning apparatus as claimed in claim 1, wherein the separation unit has a cylindrical shape.

6. The dry cleaning apparatus as claimed in claim 5, wherein the gas current through the inlet runs from inside the cylindrical separation unit to outside the cylindrical separation unit.

7. The dry cleaning apparatus as claimed in claim 1, further comprising a holding unit configured to hold the object inside the cleaning tank.

8. The dry cleaning apparatus as claimed in claim 7, wherein the holding unit is configured to move relative to the cleaning tank.

9. The dry cleaning apparatus as claimed in claim 1, further comprising an electricity discharging unit.

10. The dry cleaning apparatus as claimed in claim 1, wherein the cleaning tank is configured to keep a negative pressure in the interior space.

11. The dry cleaning apparatus as claimed in claim 1, wherein the cleaning agent has a thin piece shape.

12. The dry cleaning apparatus as claimed in claim 11, wherein the cleaning agent includes a plurality of thin pieces of varying sizes.

13. The dry cleaning apparatus as claimed in claim 11, wherein the cleaning agent includes a plurality of thin pieces of varying shapes.

14. The dry cleaning apparatus as claimed in claim 11, wherein the cleaning agent includes a plurality of thin pieces of varying materials.

* * * * *

UNITED STATES PATENT AND TRADEMARK OFFICE

CERTIFICATE OF CORRECTION

PATENT NO. : 7,743,776 B2
APPLICATION NO. : 11/660781
DATED : June 29, 2010
INVENTOR(S) : Yoichi Okamoto et al.

It is certified that error appears in the above-identified patent and that said Letters Patent is hereby corrected as shown below:

On the title page, Item (86), the PCT No. is incorrect. Item (86) should read:

-- (86) PCT No.: PCT/JP2006/311349

§ 371 (c)(1),
(2), (4) Date: Feb. 22, 2007 --

Signed and Sealed this

Second Day of November, 2010

David J. Kappos

David J. Kappos
*Director of the United States Patent and Trademark Office*